US011680359B2

(12) United States Patent
McConnell et al.

(10) Patent No.: US 11,680,359 B2
(45) Date of Patent: Jun. 20, 2023

(54) LAUNDRY TREATING APPLIANCE HAVING A TUB WITH A CLOSURE

(71) Applicant: WHIRLPOOL CORPORATION, Benton Harbor, MI (US)

(72) Inventors: Kenneth L. McConnell, Lincoln, NE (US); Kevin Gene Schneider, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 3 days.

(21) Appl. No.: 17/110,925

(22) Filed: Dec. 3, 2020

(65) Prior Publication Data

US 2021/0180239 A1 Jun. 17, 2021

Related U.S. Application Data

(60) Provisional application No. 62/947,154, filed on Dec. 12, 2019.

(51) Int. Cl.

| | |
|---|---|
| ***D06F 39/14*** | (2006.01) |
| ***D06F 37/28*** | (2006.01) |
| ***D06F 29/00*** | (2006.01) |
| ***D06F 31/00*** | (2006.01) |

(52) U.S. Cl.

CPC ..... *D06F 39/14* (2013.01); *D06F 29/005* (2013.01); *D06F 31/00* (2013.01); *D06F 37/28* (2013.01)

(58) Field of Classification Search

CPC ..... D06F 29/00; D06F 39/14; D06F 37/28; D06F 31/00; D06F 37/18; D06F 29/005

USPC ..... 68/27

See application file for complete search history.

(56) References Cited

U.S. PATENT DOCUMENTS

| | | | | |
|---|---|---|---|---|
| 4,534,188 | A | 8/1985 | Fey | |
| 7,581,414 | B2 | 9/2009 | Kim et al. | |
| 8,387,634 | B2 | 3/2013 | Dalsing | |
| 8,635,890 | B2 * | 1/2014 | Jeong | D06F 39/125 68/3 R |
| 8,950,831 | B2 | 2/2015 | Kim et al. | |

(Continued)

FOREIGN PATENT DOCUMENTS

| | | |
|---|---|---|
| EP | 2422150 B1 | 1/2013 |
| EP | 2107152 B1 | 6/2014 |

(Continued)

OTHER PUBLICATIONS

European Search Report for Counterpart EP20212327.9, dated Mar. 3, 2021, 7 Pages

*Primary Examiner* — David G Cormier
*Assistant Examiner* — Thomas Bucci
(74) *Attorney, Agent, or Firm* — McGarry Bair PC

(57) ABSTRACT

A drawer-style laundry treating appliance includes a cabinet defining an interior and having an open face. A drawer body is slidably received within the cabinet for movement through the open face between a closed position wherein the drawer body is received within the interior and an opened position wherein the drawer body is at least partially withdrawn from the interior. A tub is located within the interior, carried by the drawer body, and has a tub opening accessible when the drawer body is in the opened position, the tub further at least partially defining a treating chamber accessible through the tub opening. A tub cover selectively closes the tub opening.

20 Claims, 13 Drawing Sheets

(56) References Cited

U.S. PATENT DOCUMENTS

| | | | | |
|---|---|---|---|---|
| 9,951,458 | B2 * | 4/2018 | Jo | D06F 34/20 |
| 2008/0159907 | A1 * | 7/2008 | Joshi | A61L 2/24 422/5 |
| 2011/0127891 | A1 * | 6/2011 | Cosgrove | A47L 15/0084 312/228 |
| 2011/0265524 | A1 * | 11/2011 | Kim | D06F 29/02 68/13 R |
| 2011/0298338 | A1 * | 12/2011 | Kim | D06F 29/00 312/109 |
| 2015/0015001 | A1 * | 1/2015 | Fabbro | E05B 47/0009 292/198 |
| 2017/0002494 | A1 * | 1/2017 | Lee | D06F 34/28 |
| 2017/0002504 | A1 * | 1/2017 | Jung | D06F 37/02 |
| 2017/0356115 | A1 * | 12/2017 | Choi | D06F 34/28 |
| 2018/0023241 | A1 * | 1/2018 | Lee | E05C 19/16 312/333 |
| 2019/0112743 | A1 * | 4/2019 | Kim | D06F 39/12 |
| 2019/0194852 | A1 | 6/2019 | Lee et al. | |

FOREIGN PATENT DOCUMENTS

| | | | | |
|---|---|---|---|---|
| EP | 3112515 | A1 | 1/2017 | |
| EP | 3633128 | A1 * | 4/2020 | E05D 11/0054 |
| GB | 1289412 | A | 9/1972 | |
| KR | 20180025883 | A | 3/2018 | |
| WO | 2010131883 | A2 | 11/2010 | |

* cited by examiner

LAUNDRY TREATING APPLIANCE HAVING A TUB WITH A CLOSURE

CROSS-REFERENCE TO RELATED APPLICATIONS

This application claims the benefit of U.S. Provisional Patent Application No. 62/947,154, filed on Dec. 12, 2019, which is incorporated herein by reference in its entirety.

BACKGROUND

Laundry treating appliances, such as washing machines, combination washer/dryers, refreshers, and non-aqueous systems, can have a configuration based on a rotating laundry basket or drum that defines a drum opening and at least partially defines a treating chamber in which laundry items are placed for treating. The laundry treating appliance can have a controller that implements a number of user-selectable, pre-programmed cycles of operation having one or more operating parameters. Hot water, cold water, or a mixture thereof, along with various treating chemistries, can be supplied to the treating chamber in accordance with the cycle of operation. The laundry treating appliance can have a dispenser for loading of treating chemistries into the appliance by the user and for supplying various treating chemistries to the treating chamber.

The laundry treating appliance can include a cabinet, which can include or be provided as a drawer, including a panel or surface with an access opening through which laundry items can be loaded and unloaded into the treating chamber. A closure, door assembly, cover, or lid can be movably mounted to the cabinet or drawer, or mounted to the cabinet or drawer for movement relative to the access opening, to selectively open and close the access opening to the treating chamber. The cover or lid can be provided with a variety of mechanisms or structures for mounting, opening or closing, sealing, or movement relative to the access opening. For example, the cover can be rotatable or slidable relative to the access opening.

BRIEF SUMMARY

In one aspect, the present disclosure relates to a laundry treating system comprising a first laundry treating appliance and a drawer-style laundry treating appliance positioned below the first laundry treating appliance, the drawer-style laundry treating appliance comprising a cabinet defining an interior and having an open face, a drawer body slidably received within the cabinet for movement through the open face between a closed position wherein the drawer body is received within the interior and an opened position wherein the drawer body is at least partially withdrawn from the interior, a tub located within the interior, carried by the drawer body, and having a tub opening accessible when the drawer body is in the opened position, the tub further at least partially defining a treating chamber accessible through the tub opening, and a tub cover selectively sealingly closing the tub opening and defining a lid opening, the tub cover comprising a lid movably mounted to the tub cover for movement between opened and closed positions to selectively open or close the lid opening, and at least one automatic actuating assembly selectively biasing the lid toward at least one of the opened position or the closed position.

In another aspect, the present disclosure relates to a drawer-style laundry treating appliance comprising a cabinet defining an interior and having an open face, a drawer body slidably received within the cabinet for movement through the open face between a closed position wherein the drawer body is received within the interior and an opened position wherein the drawer body is at least partially withdrawn from the interior, a tub located within the interior, carried by the drawer body, and having a tub opening accessible when the drawer body is in the opened position, the tub further at least partially defining a treating chamber accessible through the tub opening, and a tub cover selectively sealingly closing the tub opening and defining a lid opening, the tub cover comprising a lid movably mounted to the tub cover for movement between opened and closed positions to selectively open or close the lid opening, and at least one hinge coupling the lid to the tub cover for movement between the opened and closed positions, the at least one hinge biasing the lid toward one of the opened position or the closed position.

DETAILED DESCRIPTION

Figure 1:
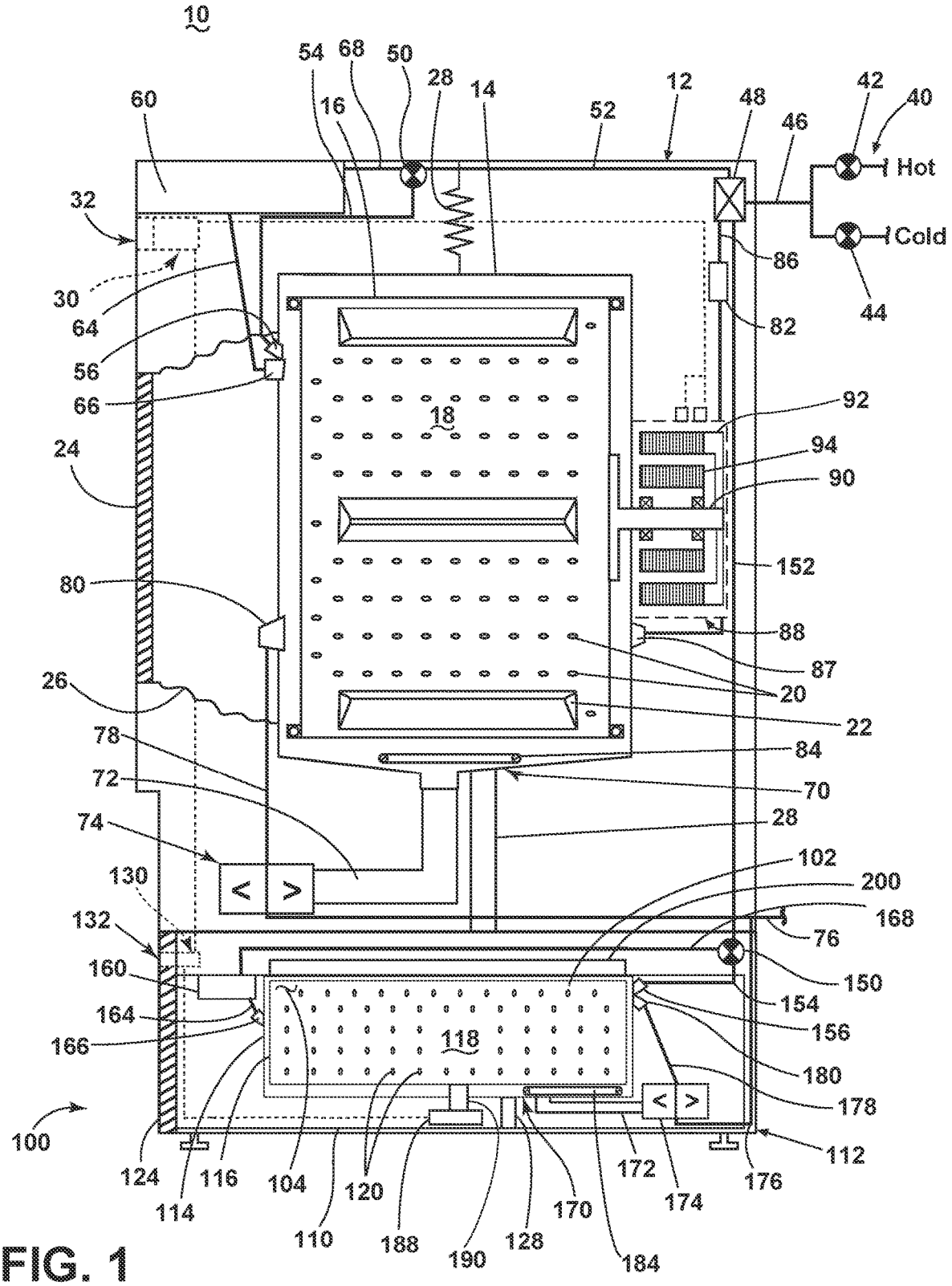
FIG. 1 is a schematic cross-sectional view of a laundry treating appliance including a pedestal laundry treating drawer having a tub cover.

FIG. 1 is a schematic cross-sectional view of a laundry treating appliance 10 according to an aspect of the present disclosure. The laundry treating appliance 10 can be any laundry treating appliance 10 which performs a cycle of operation to clean or otherwise treat laundry items placed therein, non-limiting examples of which include a horizontal or vertical axis clothes washer; a horizontal or vertical axis clothes dryer; a combination washing machine and dryer; a tumbling or stationary refreshing/revitalizing machine; an extractor; a non-aqueous washing apparatus; and a revitalizing machine. While the laundry treating appliance 10 is illustrated herein as a horizontal axis, front-load laundry treating appliance 10, the aspects of the present disclosure can have applicability in laundry treating appliances with other configurations. The laundry treating appliance 10 shares many features of a conventional automated clothes washer and/or dryer, which will not be described in detail herein except as necessary for a complete understanding of the exemplary aspects in accordance with the present disclosure.

Laundry treating appliances are typically categorized as either a vertical axis laundry treating appliance or a horizontal axis laundry treating appliance. As used herein, the term "horizontal axis" laundry treating appliance refers to a laundry treating appliance having a rotatable drum that rotates about a generally horizontal axis relative to a surface that supports the laundry treating appliance. The drum can rotate about the axis inclined relative to the horizontal axis, with fifteen degrees of inclination being one example of the inclination. Similar to the horizontal axis laundry treating appliance, the term "vertical axis" laundry treating appliance refers to a laundry treating appliance having a rotatable drum that rotates about a generally vertical axis relative to a surface that supports the laundry treating appliance. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" laundry treating appliance refers to a laundry treating appliance having a rotatable drum, perforate or imperforate, that holds fabric items and, optionally, a clothes mover, such as an agitator, impeller, nutator, and the like within the drum. The clothes mover can move within the drum to impart mechanical energy directly to the clothes or indirectly through wash liquid in the drum. The clothes mover can typically be moved in a reciprocating rotational movement. In some vertical axis laundry treating appliances, the drum rotates about a vertical axis generally perpendicular to a surface that supports the laundry treating appliance. However, the rotational axis need not be vertical. The drum can rotate about an axis inclined relative to the vertical axis.

As used herein, the "horizontal axis" laundry treating appliance refers to a laundry treating appliance having a rotatable drum, perforated or imperforate, that holds laundry items and washes and/or dries the laundry items. In some horizontal axis laundry treating appliances, the drum rotates about a horizontal axis generally parallel to a surface that supports the laundry treating appliance. However, the rotational axis need not be horizontal. The drum can rotate about an axis inclined or declined relative to the horizontal axis. In horizontal axis laundry treating appliances, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a laundry treating appliance can be top-loading or front-loading. In a top-loading laundry treating appliance, laundry items are placed into the drum through an access opening in the top of a cabinet, while in a front-loading laundry treating appliance laundry items are placed into the drum through an access opening in the front of a cabinet. If a laundry treating appliance is a top-loading horizontal axis laundry treating appliance or a front-loading vertical axis laundry treating appliance, an additional access opening is located on the drum.

In more detail, the laundry treating appliance 10 can include a structural support assembly comprising a cabinet 12 which defines a housing within which a laundry holding assembly resides. The cabinet 12 can be a housing having a chassis and/or a frame, to which decorative panels can or cannot be mounted, defining an interior, enclosing components typically found in a conventional laundry treating appliance, such as an automated clothes washer or dryer, which can include motors, pumps, fluid lines, controls, sensors, transducers, and the like. Such components will not be described further herein except as necessary for a complete understanding of the present disclosure.

The laundry holding assembly of the illustrated laundry treating appliance 10 can include a tub 14 dynamically suspended within the structural support assembly of the cabinet 12 by a suitable suspension assembly 28, the tub 14 at least partially defining a treating chamber 18 for laundry items. A rotatable drum 16 can be provided within the tub 14 to further define at least a portion of the laundry treating chamber 18. The treating chamber 18 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket.

The drum 16 can include a plurality of perforations 20 such that liquid can flow between the tub 14 and the drum 16 through the perforations 20. A plurality of baffles 22 can be disposed on an inner surface of the drum 16 to lift the laundry load received in the treating chamber 18 while the drum 16 rotates. It is also within the scope of the present disclosure for the laundry holding assembly to comprise only one receptacle, such as the tub 14 without the drum 16, or the drum 16 without the tub 14, with the single receptacle defining the laundry treating chamber 18 for receiving the load to be treated.

The laundry holding assembly can further include a closure, illustrated herein as a door assembly 24, which can be movably mounted to or coupled to the cabinet 12 to selectively close both the tub 14 and the drum 16, as well as the treating chamber 18. In one example, the door assembly 24 can be rotatable relative to the cabinet 12. By way of non-limiting example, the door assembly 24 can be hingedly coupled to the cabinet 12 for movement between an opened condition (not shown) and a closed condition as shown.

A bellows 26 can extend between the tub 14 and the cabinet 12 to couple an open face of the tub 14 with the cabinet 12, with the door assembly 24 sealing against the bellows 26 or the cabinet 12, or both, when the door assembly 24 closes the tub 14. In the opened condition, the door assembly 24 can be spaced apart from the bellows 26 and can allow access to the treating chamber 18. The bellows 26 can sealingly couple the open face of the tub 14 with the cabinet 12 such that liquid is not permitted to move from the tub 14 into the interior of the cabinet 12.

The laundry treating appliance 10 can further comprise a washing circuit which can include a liquid supply assembly for supplying liquid, such as water or a combination of water and one or more wash aids, such as detergent, to the laundry treating appliance 10 for use in treating laundry during a cycle of operation. The liquid supply assembly can include a source of water, such as a household water supply 40, which can include separate valves 42 and 44 for controlling the flow of hot and cold water, respectively. The valves 42, 44 can be opened individually or together to provide a mix of hot and cold water at a selected temperature. The valves 42, 44 are selectively openable to provide water, such as from the household water supply 40, to be supplied through an inlet conduit 46 directly to the tub 14 or the drum 16 by controlling first and second diverter mechanisms 48 and 50, respectively. The diverter mechanisms 48, 50 can each be a diverter valve having two outlets such that each of the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14 in a desired pattern and under a desired amount of pressure. For example, the spray nozzle 56 can be configured to dispense a flow or stream of water into the tub 14 by gravity, i.e. a non-pressurized stream. In this manner, water from the household water supply 40 can be supplied directly to the tub 14. While the valves 42, 44 and the conduit 46 are illustrated exteriorly of the cabinet 12, it will be understood that these components can be internal to the cabinet 12.

The laundry treating appliance 10 can also be provided with a dispensing assembly for dispensing treating chemistry to the treating chamber 18 for use in treating the laundry according to a cycle of operation. The dispensing assembly can include a treating chemistry dispenser 60 which can be a single dose dispenser, a bulk dispenser, or an integrated single dose and bulk dispenser and is fluidly coupled to the treating chamber 18. The treating chemistry dispenser 60 can be configured to dispense a treating chemistry directly to the tub 14 or mixed with water from the liquid supply assembly through a dispensing outlet conduit 64. The treating chemistry dispenser 60 can include means for supplying or mixing detergent to or with water from the water supply 40. Alternatively, or additionally, water from the water supply 40 can also be supplied to the tub 14 through the treating chemistry dispenser 60 without the addition of a detergent. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the treating chemistry dispenser 60 from the supply conduit 52 by directing the diverter mechanism 50 to direct the flow of water to a dispensing supply conduit 68.

The treating chemistry dispenser 60 can include multiple chambers or reservoirs for receiving doses of different treating chemistries. The treating chemistry dispenser 60 can be implemented as a dispensing drawer that is slidably received within the cabinet 12, or within a separate dispenser housing which can be provided in the cabinet 12. The treating chemistry dispenser 60 can be moveable between a fill position, where the treating chemistry dispenser 60 is exterior to the cabinet 12 and can be filled with treating chemistry, and a dispense position, where the treating chemistry dispenser 60 is interior of the cabinet 12.

Non-limiting examples of treating chemistries that can be dispensed by the dispensing assembly during a cycle of operation include one or more of the following: water, detergents, surfactants, enzymes, fragrances, stiffness/sizing agents, wrinkle releasers/reducers, softeners, antistatic or electrostatic agents, stain repellents, water repellents, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

The laundry treating appliance 10 can also include a recirculation and drain assembly for recirculating liquid within the laundry holding assembly and draining liquid from the laundry treating appliance 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can have an inlet fluidly coupled with the sump 70 and an outlet configured to fluidly couple and to direct liquid to a drain conduit 76, which can drain the liquid from the laundry treating appliance 10, or to a recirculation conduit 78, which can terminate at a recirculation inlet 80. In this configuration, the pump 74 can be used to drain or recirculate wash water in the sump 70. The recirculation inlet 80 can direct the liquid from the recirculation conduit 78 into the drum 16 by fluidly coupling the recirculation conduit 78 with the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry, can be recirculated into the treating chamber 18 for treating the laundry within. The recirculation and drain assembly can include other types of recirculation systems.

The liquid supply and/or recirculation and drain assembly can be provided with a heating assembly which can include one or more devices for heating laundry and/or liquid supplied to the tub 14, such as a steam generator 82 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation. The sump heater 84 can be provided within the sump 70 to heat liquid that collects in the sump 70. Alternatively, the heating assembly can include an in-line heater that heats the liquid as it flows through the liquid supply, dispensing, and/or recirculation assemblies.

It is noted that the illustrated suspension assembly, liquid supply assembly, recirculation and drain assembly, and dispensing assembly are shown for exemplary purposes only and are not limited to the assemblies shown in the drawings and described above. For example, the liquid supply, dispensing, and recirculation and pump assemblies can differ from the configuration shown in FIG. 1, such as by inclusion of other valves, conduits, treating chemistry dispensers, heaters, sensors (such as water level sensors and temperature sensors), and the like, to control the flow of liquid through the laundry treating appliance 10 and for the introduction of more than one type of treating chemistry. For example, the liquid supply assembly can include a single valve for controlling the flow of water from the household water source. In another example, the recirculation and pump assembly can include two separate pumps for recirculation and draining, instead of the single pump as previously described. In yet another example, the liquid supply assembly can be configured to supply liquid into the interior of the drum 16 or into the interior of the tub 14 not occupied by the drum 16, such that liquid can be supplied directly to the tub 14 without having to travel through the drum 16.

The laundry treating appliance 10 also includes a drive assembly for rotating the drum 16 within the tub 14. The drive assembly can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used.

The motor 88 can rotationally drive the drum 16, including that the motor 88 can rotate the drum 16 at various speeds in either rotational direction. In particular, the motor 88 can rotate the drum 16 at tumbling speeds wherein the laundry items in the drum 16 rotate with the drum 16 from a lowest location of the drum 16 towards a highest location of the drum 16, but fall back to the lowest location of the drum 16 before reaching the highest location of the drum 16. The rotation of the laundry items with the drum 16 can be facilitated by the baffles 22. Typically, the force applied to the laundry items at the tumbling speeds is less than about 1 G. Alternatively, the motor 88 can rotate the drum 16 at spin speeds wherein the laundry items rotate with the drum 16 without falling. The spin speeds can also be referred to as satellizing speeds or sticking speeds. Typically, the force applied to the laundry items at the spin speeds is greater than or about equal to 1 G. As used herein, "tumbling" of the drum 16 refers to rotating the drum 16 at a tumble speed, "spinning" the drum 16 refers to rotating the drum 16 at a spin speed, and "rotating" of the drum 16 refers to rotating the drum 16 at any speed.

The laundry treating appliance 10 also includes a control assembly for controlling the operation of the laundry treating appliance 10 and its various working components to control the operation of the working components and to implement one or more treating cycles of operation. The control assembly can include a controller 30 located within the cabinet 12 and a user interface 32 that is operably coupled with the controller 30. The user interface 32 can provide an input and output function for the controller 30. In one example, the user interface 32 can be provided or integrated with the door assembly 24. In another example, as shown, the user interface 32 can be provided on a front panel of the cabinet 12.

The user interface 32 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the laundry treating appliance 10 and can allow the controller 30 to communicate with the user in a variety of ways. For example, the controller 30 can be configured to send a text message to the user, send an electronic mail to the user, or provide audio information to the user either through the laundry treating appliance 10 or utilizing another device such as a mobile phone.

The controller 30 can include the machine controller and any additional controllers provided for controlling any of the components of the laundry treating appliance 10. For example, the controller 30 can include the machine controller and a motor controller. Many known types of controllers can be used for the controller 30. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

The laundry treating appliance 10 can further comprise a drawer-style laundry treating appliance, illustrated herein as a pedestal laundry treating drawer 100. The laundry treating drawer 100 is similar to the laundry treating appliance 10 and shares many of the same features and components as the laundry treating appliance 10, but differs in some aspects, such as the manner in which the laundry treating drawer 100 is accessed by a user. Therefore, elements of the laundry treating drawer 100 that are similar to those of the laundry treating appliance 10 are identified with numerals increased by 100, with it being understood that the description of the like parts of the laundry treating appliance 10 applies to the laundry treating drawer 100, unless otherwise noted.

While the laundry treating drawer 100 is illustrated herein as a vertical axis, top load laundry treating drawer 100, the aspects of the present disclosure can have applicability in laundry treating drawers with other configurations. The laundry treating drawer 100 shares many features of a conventional automated clothes washer and/or dryer, which will not be described in detail herein except as necessary for a complete understanding of the exemplary aspects in accordance with the present disclosure.

The laundry treating drawer 100 includes a structural support assembly comprising an open-face drawer cabinet 112, which defines a housing, which can be thought of as a drawer housing, and an interior, within which a laundry holding assembly resides. The drawer cabinet 112 can be provided as a pedestal that is located below and can support the laundry treating appliance 10. A drawer body 110, which can be an open top drawer body 110, is mounted to and slidably received within the drawer cabinet 112, or within a separate drawer housing that can be provided in the drawer cabinet 112. The laundry treating drawer 100 can further include a closure, illustrated herein as a drawer front 124, that is coupled with the drawer body 110 for slidable movement relative to the drawer cabinet 112 to selectively close the drawer cabinet 112.

The drawer body 110 supports and carries, by a suspension assembly 128, an imperforate tub 114 and a perforated open top drum 116 that is rotatably mounted within the tub 114 and at least partially defines a treating chamber 118. The drawer body 110, along with the drawer front 124, is moveable relative to the drawer cabinet 112 between a closed position, as shown, which can be thought of as a treating position, wherein the drawer body 110 and the treating chamber 118 are interior of the drawer cabinet 112 and inaccessible by a user and the drawer front 124 closes the drawer cabinet 112, and an opened position (FIG. 3), which can be thought of as an access position, wherein the drawer front 124, at least a portion of the drawer body 110, and at least a portion of the treating chamber 118 extend forwardly from and are exterior to the drawer cabinet 112 and can be accessed by a user.

The drawer cabinet 112 and the drawer body 110 can be of any suitable size, especially height, to accommodate the tub 114 and the drum 116, as well as a desired capacity for the treating chamber 118, and further yet taking into account the height of the laundry treating appliance 10. In one example, the laundry treating drawer 100 has a low capacity relative to a capacity of the laundry treating appliance 10. By way of non-limiting example, the tub 114 can have a height between 6 and 12 inches, further between 10 and 12 inches. Further by way of non-limiting example, although the laundry treating drawer 100 can be used for any loads of fabric items that will fit within the treating chamber 118, such as small volume loads, the laundry treating drawer 100 can be configured for gentle washing of laundry items that require special care, such as laundry items that are intended to be hand washed or washed in a delicate wash cycle.

The rotatable drum 116 includes a plurality of perforations 120 and has an open top 102 that can be disposed within the interior of the drawer cabinet 112 when the laundry treating drawer 100 is in the closed position, and further can be disposed within the interior of the drawer body 110, and can also at least partially define the rotatable treating chamber 118 and an access opening 104. The access opening 104 can provide access to the treating chamber 118. The open top 102 can be aligned with the access opening 104. The tub 114 can be at least partially aligned with the access opening 104 and the open top 102. In one example, the tub 114 and the drum 116, along with the open top 102, and the access opening 104, can have central axes that are co-axial with one another, or with at least one of the other axes, such that a common central axis is formed and can define a vertical drum 116 axis of rotation. It is also within the scope of the present disclosure for the laundry holding assembly to comprise only one receptacle, such as the tub 114 without the drum 116, or the drum 116 without the tub 114, with the single receptacle defining the laundry treating chamber 118 for receiving the load to be treated.

A selectively openable closure or lid, illustrated herein as comprising a tub cover 200, can have at least a portion that is movably mounted to or coupled to the drawer body 110 or that is mounted to or coupled to the drawer cabinet 112 to selectively open and close the access opening 104, as well as the tub 114, the drum 116, and the open top 102, and to selectively provide access to the treating chamber 118 through the access opening 104. The tub cover 200, or the at least a portion of the tub cover 200, can selectively move relative to the access opening 104 between an opened position (FIGS. 10, 13, 16-18) and a closed position as shown, such as, by way of non-limiting example, by rotatable or pivotable movement, by hinged coupling, or by slidable movement relative to the access opening 104. The tub cover 200 can seal the access opening 104 and can at least partially confront the treating chamber 118 when the tub cover 200 is in the closed position. In the opened position, the tub cover 200 can be spaced apart from the access opening 104 and can allow access to the access opening 104.

The drum 116 can optionally include a laundry mover (not shown) that can be rotatably mounted within the drum 116 to impart mechanical agitation to a load of laundry items placed in the drum 116. The laundry mover can be oscillated or rotated about its vertical axis of rotation during a cycle of operation in order to produce load motion effective to wash the load contained within the treating chamber 118. Non-limiting exemplary types of laundry movers include, but are not limited to, an agitator, a wobble plate, and a hybrid impeller/agitator. The drum 116, and optionally the laundry mover, can be driven, such as to rotate within the tub 114, by a drive assembly including a motor 188 coupled with the drum 116 through a drive shaft 190.

The laundry treating drawer 100 can further comprise a variety of components and assemblies in common with the laundry treating appliance 10, or can be coupled with various components and assemblies of the laundry treating appliance 10. For example, the laundry treating drawer 100 can be fluidly coupled with the liquid supply assembly of the laundry treating appliance 10 by way of a drawer supply conduit 152 fluidly coupling the laundry treating drawer 100 with the first diverter mechanism 48 to supply water from the household water supply 40 to the laundry treating drawer 100. A drawer diverter mechanism 150 on the drawer supply conduit 152 can direct the flow of liquid to a drawer tub outlet conduit 154 and a drawer spray nozzle 156 to spray liquid into the tub 114. While the laundry treating drawer 100 is illustrated herein as being coupled to the household water supply 40 via the liquid supply circuit and the valves 42, 44 of the laundry treating appliance 10, it will be understood that the laundry treating drawer 100 can instead have its own liquid supply assembly to couple directly to the household water supply 40 independently of the laundry treating appliance 10.

The laundry treating drawer 100 can also be provided with a treating chemistry dispenser 160 that is fluidly coupled to the treating chamber 118 by a drawer dispensing outlet conduit 164 having a dispensing nozzle 166 and is fluidly coupled to the supply conduit 152 by a drawer dispensing supply conduit 168 and the drawer diverter mechanism 150. The treating chemistry dispenser 160 can be provided in a drawer configuration or as at least one reservoir fluidly coupled to the treating chamber 118. The treating chemistry dispenser 160 can receive treating chemistry from the treating chemistry dispenser 60 of the laundry treating appliance 10 by way of an optional dispenser feed conduit (not shown), or the drawer treating chemistry dispenser 160 can operate autonomously and independently of the laundry treating appliance 10.

The laundry treating drawer 100 can also include a recirculation and drain assembly that may or may not be fluidly coupled with the recirculation and drain assembly of the laundry treating appliance 10. The tub 114 at least partially defines a sump 170 that couples to a pump 174 by a sump conduit 172. The pump 174 fluidly couples the sump 170 either to the treating chamber 118 by a recirculation conduit 178 and a recirculation inlet 180, or to a drain conduit 176 which can drain the liquid from the laundry treating drawer 100 independently of the laundry treating appliance 10 or via the drain conduit 76 of the laundry treating appliance 10. A sump heater 184 can be provided within the sump 170. Alternatively, or additionally, the laundry treating drawer 100 can be coupled with the steam generator 82 of the laundry treating appliance 10 or can include a separate steam generator (not shown) independently of the laundry treating appliance 10.

The laundry treating drawer 100 also includes a control assembly comprising a controller 130 that is located within the drawer cabinet 112 and a user interface 132 that is operably coupled with the controller 130. The user interface 132 can be provided or integrated with the drawer front 124, as shown, or can be provided at any other suitable location, including on a panel of the drawer cabinet 112 or the drawer body 110. The controller 130 and the user interface 132 of the laundry treating drawer 100 can operate entirely independently of the laundry treating appliance 10, such that a user can operate the laundry treating drawer 100 solely by way of the user interface 132. Alternatively, or in addition, the controller 130 and the user interface 132 of the laundry treating drawer 100 can be operated under the control of the controller 30 and the user interface 32 of the laundry treating appliance 10, such that a user could input cycle selections for the laundry treating drawer 100 at either the drawer user interface 132 or the user interface 132 of the laundry treating appliance 10.

Figure 2:
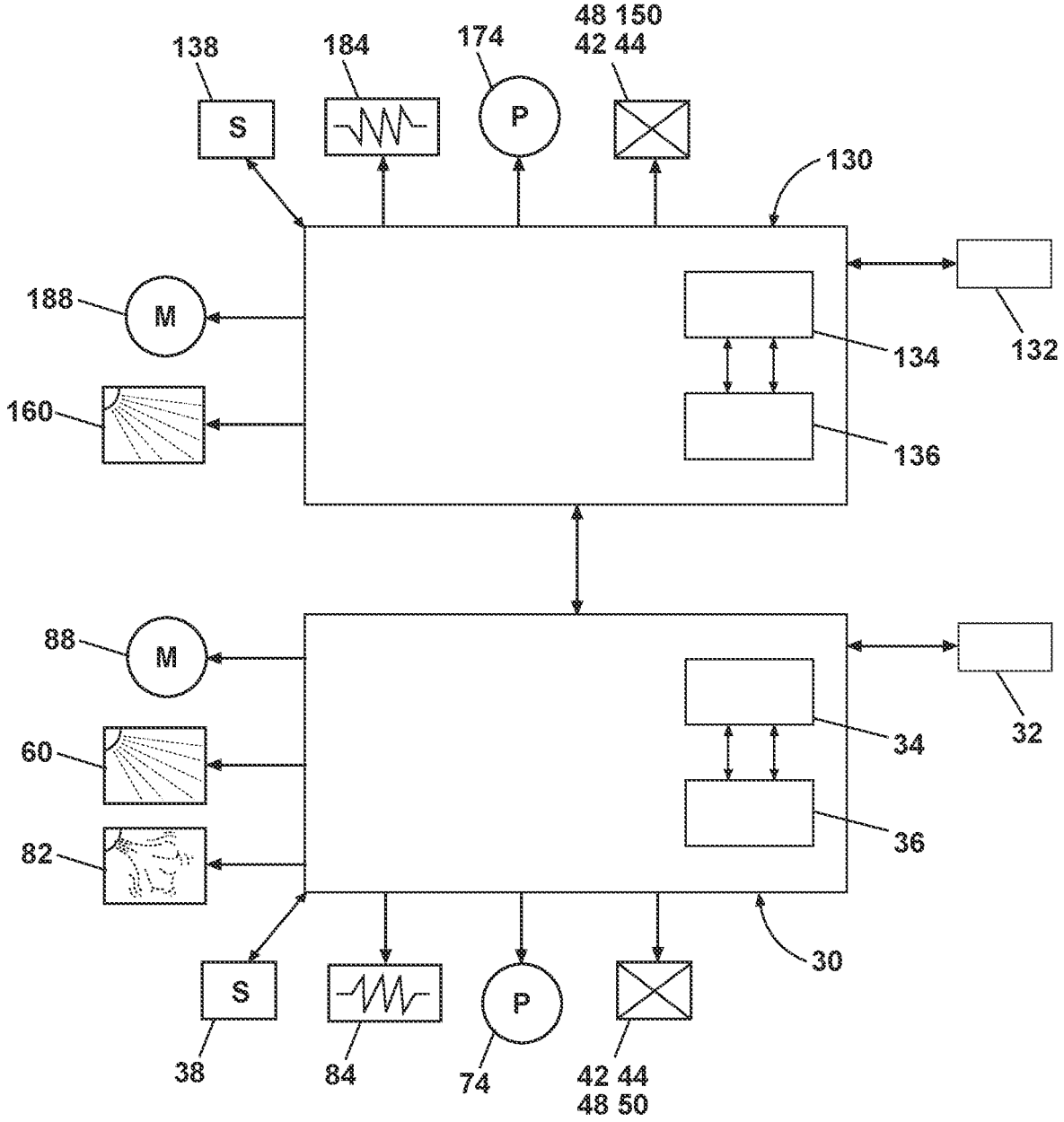
FIG. 2 is a schematic of a control assembly of the laundry treating appliance and the laundry treating drawer of FIG. 1.

As illustrated in FIG. 2, either of or both of the controllers 30, 130 can be provided with a memory 34, 134 and a central processing unit (CPU) 36, 136. The memory 34, 134 can be used for storing the control software that is executed by the CPU 36, 136 in completing a cycle of operation using the laundry treating appliance 10 and/or the laundry treating drawer 100, respectively, and any additional software. For example, the memory 34, 134 can store a set of executable instructions including at least one user-selectable cycle of operation. Examples, without limitation, of cycles of operation include: wash, heavy duty wash, delicate wash, quick wash, pre-wash, refresh, rinse only, timed wash, dry, heavy duty dry, delicate dry, quick dry, or automatic dry, which can be selected at the user interface 32, 132. The memory 34, 134 can also be used to store information, such as a database or table, and to store data received from one or more components of the laundry treating appliance 10 or the laundry treating drawer 100 that can be communicably coupled with the controller 30, 130. The database or table can be used to store the various operating parameters for the one or more cycles of operation, including factory default values for the operating parameters and any adjustments to them by the control assembly or by user input.

The controllers 30, 130 can be operably coupled with one or more components of the laundry treating appliance 10 and/or the laundry treating drawer 100 for communicating with and controlling the operation of the component to complete a cycle of operation. For example, the controllers 30, 130 can be operably coupled with the valves 42, 44 and the diverter mechanisms 48, 50, 150 for controlling the temperature and flow rate of treating liquid into the treating chamber 18, 118, the motor 88, 188 for controlling the direction and speed of rotation of the drum 16, 116, the pump 74, 174 for controlling the amount of treating liquid in the treating chamber 18, 118 or sump 70, 170, the treating chemistry dispenser 60, 160 for controlling the flow of treating chemistries into the treating chamber 18, 118, the user interface 32, 132 for receiving user selected inputs and communicating information to the user, the steam generator 82, and the sump heater 84, 184 to control the operation of these and other components to implement one or more of the cycles of operation.

The controllers 30, 130 can also be coupled with one or more sensors 38, 138 provided in one or more of the assemblies of the laundry treating appliance 10 and/or the laundry treating drawer 100 to receive input from the sensors 38, 138, which are known in the art and not shown for simplicity. Non-limiting examples of sensors 38, 138 that can be communicably coupled with the controller 30, 130 include: a treating chamber temperature sensor, such as a thermistor, which can detect the temperature of the treating liquid in the treating chamber 18, 118 and/or the temperature of the treating liquid being supplied to the treating chamber 18, 118, a moisture sensor, a weight sensor, a chemical sensor, a position sensor, an imbalance sensor, a load size sensor, and a motor torque sensor, which can be used to determine a variety of assembly and laundry characteristics, such as laundry load inertia or mass.

Although the laundry treating appliance 10 and the laundry treating drawer 100 and their respective components have been discussed herein in the context of the laundry treating drawer 100 being provided as a pedestal laundry treating drawer 100 underlying and supporting the laundry treating appliance 10, it will be understood that the laundry treating drawer 100 is not limited to inclusion as a pedestal to a laundry treating appliance 10. Instead, the laundry treating drawer 100 can be a completely independent drawer-style laundry treating appliance 100 that is provided separately from another laundry treating appliance 10.

Figure 3:
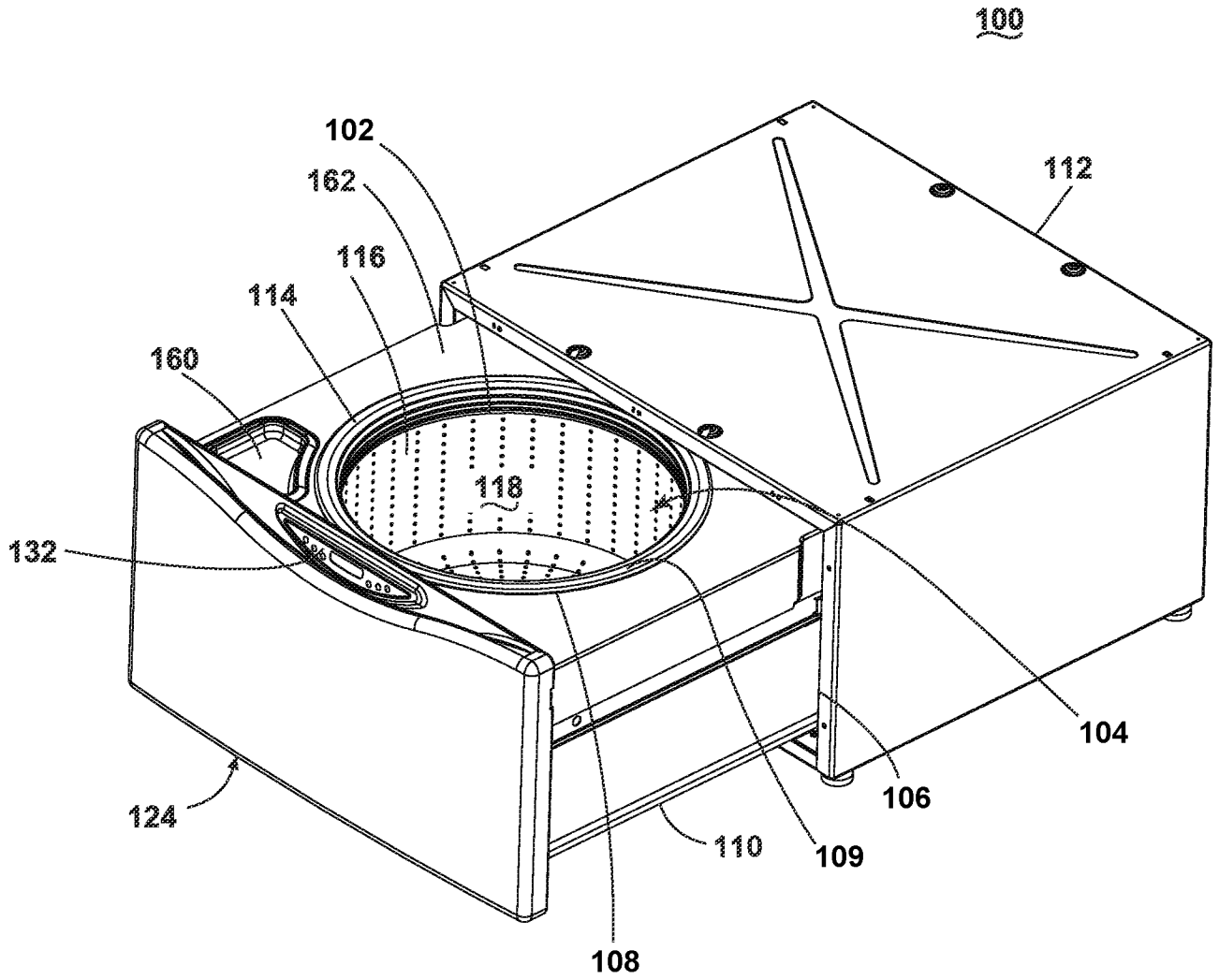
FIG. 3 is a top perspective view of the laundry treating drawer of FIG. 1 with a drawer body in an opened position and the tub cover removed.

Referring now to FIG. 3, the laundry treating drawer 100 is shown separately from the laundry treating appliance 10, and with the drawer body 110 in the opened position and the tub cover 200 removed for a better view of the interior. It can be seen that the drawer cabinet 112 includes an open face 106 that receives the drawer body 110 for the slidable movement of the drawer body 110 and the drawer front 124 relative to the open face 106 and between the opened and closed positions. The movement of the drawer body 110 and the drawer front 124 between the opened and closed positions selectively closes the open face 106 such that at least the drawer front 124 closes the open face 106 when the drawer body 110 is in the closed position. With the drawer body 110 in the opened position as shown, and with the tub cover 200 removed, the open top 102 and the access opening 104 extend forwardly from the drawer cabinet 112 and are accessible by a user.

The drawer body 110 can include a top panel 162 extending across the width of the drawer body 110 and at least partially closing the drawer body 110. The top panel 162 defines a tub opening 108 within which the tub 114, as well as the drum 116, can be received, such that the tub 114 and the drum 116, as well as the treating chamber 118, are carried by and supported by the top panel 162. The top panel 162 can comprise a shroud 109 or can couple with the shroud 109. The shroud 109 can define at least a portion of the access opening 104, such that the shroud 109 can at least partially encircle the access opening 104. The shroud 109 can curve downwards toward the treating chamber 118 to direct laundry items into the drum 116. The shroud 109 can overlie a portion of the drum 116 or the treating chamber 118 such that the laundry items do not fall between the drum 116 and the tub 114.

The treating chemistry dispenser 160 can also be provided with or carried by the top panel 162 and located adjacent to the tub 114. While the treating chemistry dispenser 160 is illustrated herein as being provided at the top panel 162, it will be understood that other locations for the treating chemistry dispenser 160 can be contemplated, such as at a different location within or on the drawer cabinet 112.

Figure 4:
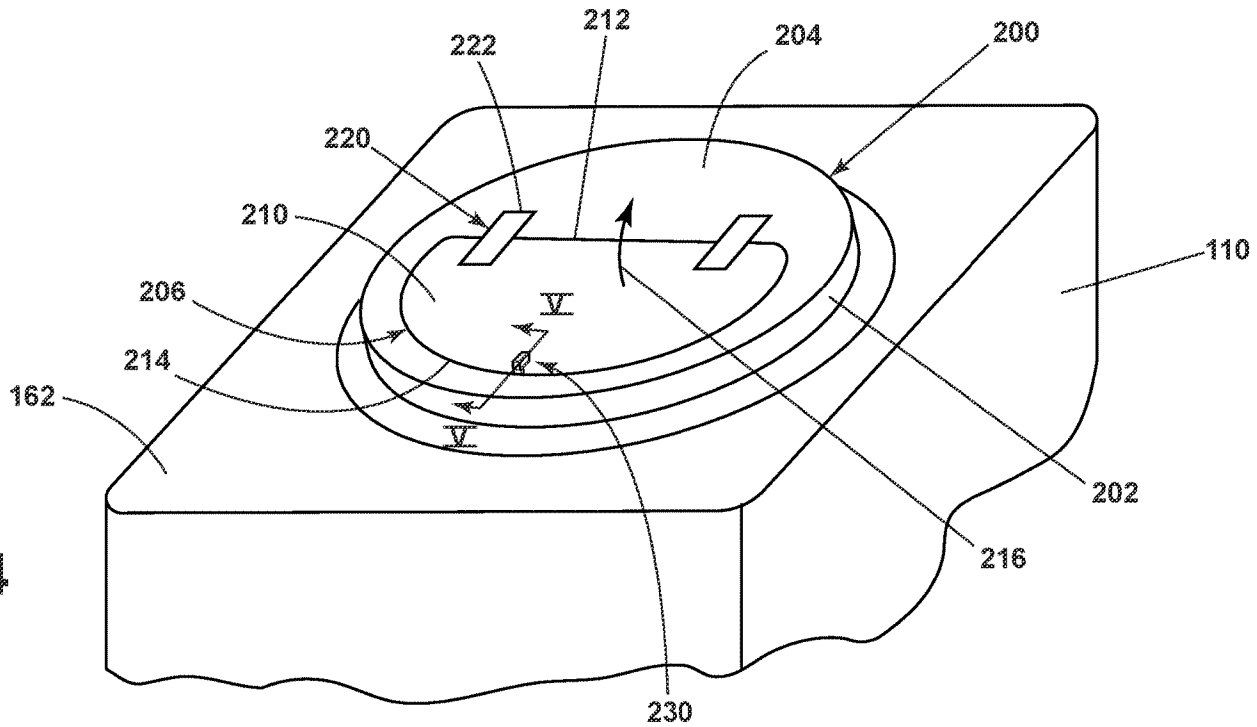
FIG. 4 is a schematic perspective view of an example of the tub cover having a closure assembly for use with the laundry treating drawer of FIG. 1.

Referring now to FIG. 4, an exemplary tub cover 200 can be provided with the laundry treating drawer 100 to selectively sealingly close the access opening 104 and to prevent liquid or humidity from splashing or flowing out of the treating chamber 118 and to the surrounding drawer body 110 or to the drawer cabinet 112. The tub cover 200 at least partially closes the access opening 104. The tub cover 200 comprises a sidewall 202 and a top surface 204 that surround and at least partially enclose the tub opening 108. The sidewall 202 and the top surface 204 can be fixed to or coupled, either directly or indirectly, to the drawer body 110, and in particular to the top panel 162.

The top surface 204 defines a lid opening 206 that receives a lid 210 having a rear edge 212 and a front edge 214 and is movably coupled to the top surface 204 for movement between a closed position, as shown, and an opened position, in the direction of the arrow 216. When the lid 210 is in the closed position, the access opening 104 is closed, the lid 210 at least partially confronts the treating chamber 118, and access to the treating chamber 118 is prevented. When the lid 210 is in the opened position, the lid 210 is spaced from the access opening 104 and the treating chamber 118 such that a user can access the treating chamber 118 through the access opening 104. The lid 210 can seal against the top surface 204, either directly or indirectly, such as by way of a gasket (not shown) provided between the lid 210 and the top surface 204.

As illustrated herein, the lid 210 can extend across a portion of the width and depth of the top surface 204 so as to overlie only a portion of the access opening 104. However, it will be understood that the lid 210 can have any suitable size and shape relative to the top surface 204, including that the lid 210 can extend across the entire width and depth of the top surface 204 and overlie the entire access opening 104, such as to form an edge-to-edge lid. In one example, the size and shape of the lid 210 can be selected based on the extent to which the drawer body 110 can be withdrawn from the drawer cabinet 112, to maximize the size of the lid 210 while ensuring that the lid 210 can be opened all the way when the drawer body 110 may only be configured to be partially withdrawn from the drawer cabinet 112 in the opened position. The lid 210 can be provided entirely above the top surface 204, with no part of the lid 210 being provided in plane with or below the top surface 204. Alternatively, the lid 210 can be provided as, for example, an at least partially recessed lid 210 wherein at least a portion of the lid 210 is recessed into the top surface 204 such that the top surface 204 surrounds and abuts at least a portion of a periphery of the lid 210, which can include the rear edge 212 and the front edge 214. In either example, it will be understood that the lid 210 can overlie and extend across less than or equal to the entire width and the entire depth of the top surface 204. The lid 210 can comprise glass, metal, plastic, composite, or any other suitable material.

In this example, the lid 210 is pivotably or rotatably coupled to the top surface 204 by at least one hinge 220 for rotation between the opened and closed positions. The at least one hinge 220 can couple the lid 210 for rotational movement relative to the top surface 204 about an axis of rotation defined by a rear edge 222 of the at least one hinge 220. Alternatively, the hinge 220 can define an axis of rotation for the lid 210 that is provided at a central portion of the hinge 220, such that the at least one hinge 220 allows for rotational movement of the lid 210 about the axis of rotation defined by the rear edge 212 of the lid 210. In one example, the at least one hinge 220 allows for over central travel of the lid 210 about the at least one hinge 220. In a further example, the hinge 220 can be spring-loaded so as to bias the lid 210 toward the opened position as in the direction of the arrow 216.

The lid 210 can further include a suitable closure assembly 230 to secure the lid 210 in the closed position, particularly in the case that the lid 210 is biased toward the opened position, such as by the spring-loaded hinge 220. The closure assembly 230 can be provided on at least one of the lid 210 or the top surface 204 for selective engagement or coupling with the other of the lid 210 or the top surface 204. The closure assembly 230 can be configured to resiliently retain the lid 210 in the closed position until sufficient force or actuation is applied to overcome the coupling of the lid 210 with the top surface 204 by the closure assembly 230. By way of non-limiting example, such a closure assembly 230 can include any suitable coupling mechanism, such as a latch, a hook, or a snap mechanism.

Figure 5:
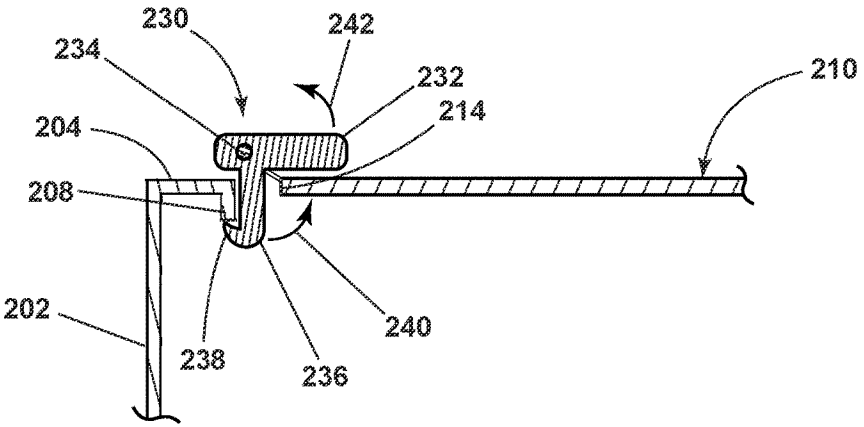
FIG. 5 is a schematic cross-sectional view of the closure assembly of FIG. 4.

Referring now to FIG. 5, an example of the closure assembly 230 is illustrated herein as an actuatable pivot latch 230. The pivot latch 230 is coupled with and carried by the lid 210 and can be located at the front edge 214 of the lid 210. The pivot latch 230 is rotatable relative to the lid 210 about an actuation axis of rotation 234, which can be defined as a pin 234. The pivot latch 230 comprises a grip portion 232 and an engagement portion 236. In one example, the grip portion 232 extends away from the axis of rotation 234 and along the lid 210. The grip portion 232 can extend away from the axis of rotation 234 such that it extends inwardly from the front edge 214 of the lid 210 and in a manner that is substantially parallel to the lid 210. The engagement portion 236 can extend away from the axis of rotation 234 in a direction that is substantially orthogonal to the grip portion 232 and to the lid 210. The engagement portion 236 includes a catch flange 238 extending away from the engagement portion 236 and away from the lid 210, towards the sidewall 202 of the tub cover 200.

When the lid 210 and the pivot latch 230 are in the closed position, as shown, the catch flange 238 bears against a lip 208 that extends downwardly from the top surface 204 such that the catch flange 238 is biased against the lip 208 to retain the lid 210 in the closed position by the upward force that is applied by the spring-loaded hinge 220 to the lid 210. While the pivot latch 230 is illustrated herein as being provided on the lid 210 to latch against the tub cover 200, it will be understood that the positions can be switched such that the pivot latch 230 is provided on the tub cover 200 to latch against the lid 210.

Turning now to the operation of the pivot latch 230, when a user desires to open the lid 210 to access the treating chamber 118, the user can grasp the grip portion 232 and pull upwardly on the grip portion 232 in the direction as shown by the arrow 242, causing the pivot latch 230 to rotate about the axis of rotation 234, such as to pivot upwardly. As the pivot latch 230 rotates about the axis of rotation 234, the engagement portion 236 is similarly rotated, in the direction as shown by the arrow 240. This rotational movement brings the catch flange 238 out of contact with the lip 208 such that the lid 210 is no longer retained in the closed position and can be lifted and rotated to the opened position, free from interference of the catch flange 238 contacting the lip 208.

When the lid 210 is returned to the closed position, the user need not actuate the pivot latch 230, but instead can simply press the lid 210 downwardly toward the closed position until the pivot latch 230 snaps back into a retaining engagement with the tub cover 200. When the engagement portion 236, and in particular the catch flange 238 comes into contact with the top surface 204 along its downward movement, the pivot latch 230 is deflected out of the way by the top surface 204, as well as by the lip 208, to allow the lid 210 to reach the closed position. When the lid 210 reaches the closed position, the catch flange 238 is positioned vertically below the lip 208, such that the catch flange 238 is no longer deflected inwardly by the lip 208, allowing the pivot latch 230 to return to a non-actuated and non-deflected position, wherein the catch flange 238 is below and bears upwardly against the lip 208 to prevent movement of the lid 210 to the opened position. The pivot latch 230 can be biased toward this position or can occupy the non-actuated and non-deflected position by gravity.

Figure 6:
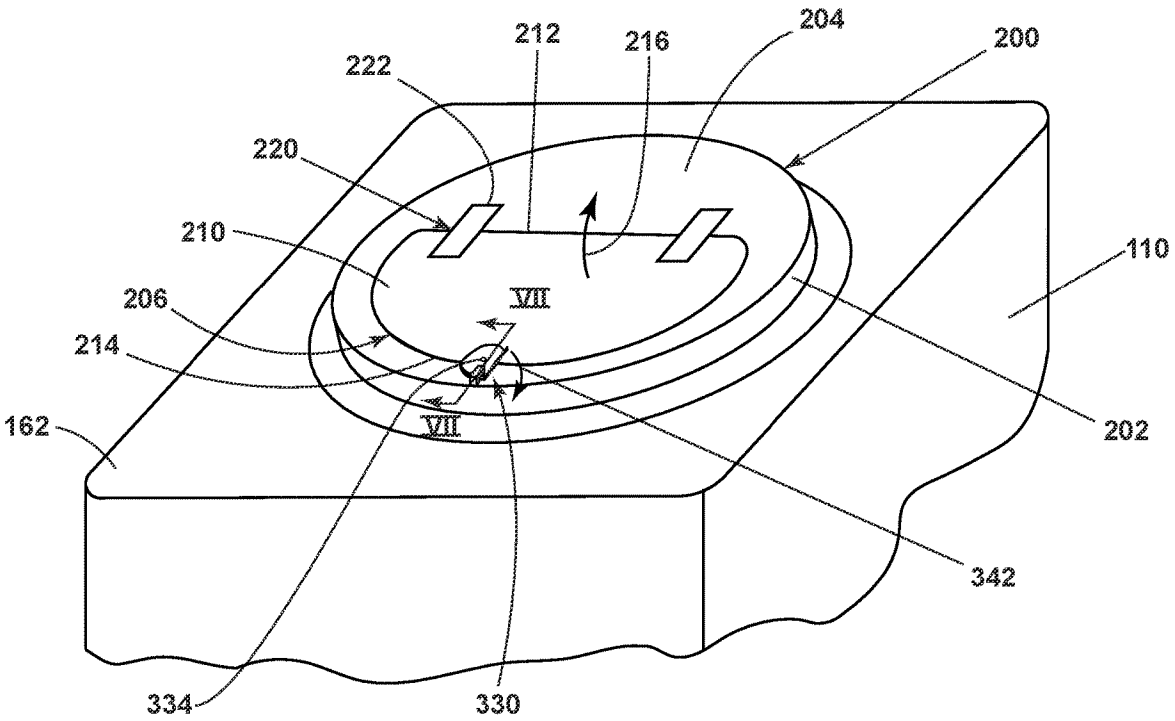
FIG. 6 is a schematic perspective view of another example of a closure assembly for use with the tub cover of FIG. 4.

Turning now to FIG. 6, another example of a closure assembly 330, illustrated herein as an actuatable twist latch 330, that can selectively secure the lid 210 in the closed position is shown. The closure assembly 330 is similar to the closure assembly 230, but differs in some aspects, such as the manner in which the twist latch 330 is actuated by a user as compared to the pivot latch 230. Therefore, elements of the twist latch 330 that are similar to those of the pivot latch 230 are identified with numerals increased by 100, with it being understood that the description of the like parts of the pivot latch 230 applies to the twist latch 330, unless otherwise noted.

The twist latch 330, like the pivot latch 230, is coupled with and carried by the lid 210 along the front edge 214 of the lid 210. The twist latch 330 differs from the pivot latch 230 at least in that the twist latch 330 is rotatable relative to the lid 210 about an actuation axis of rotation 334 in a direction shown by the arrow 342 such that the twist latch 330 rotates in a plane that is parallel to the lid 210, rather than in a plane that is orthogonal to the lid 210 as in the case of the pivot latch 230. While the twist latch 330 is illustrated herein as being provided on the lid 210 to latch against the tub cover 200, it will be understood that the positions can be switched such that the twist latch 330 is provided on the tub cover 200 to latch against the lid 210.

Figure 7:
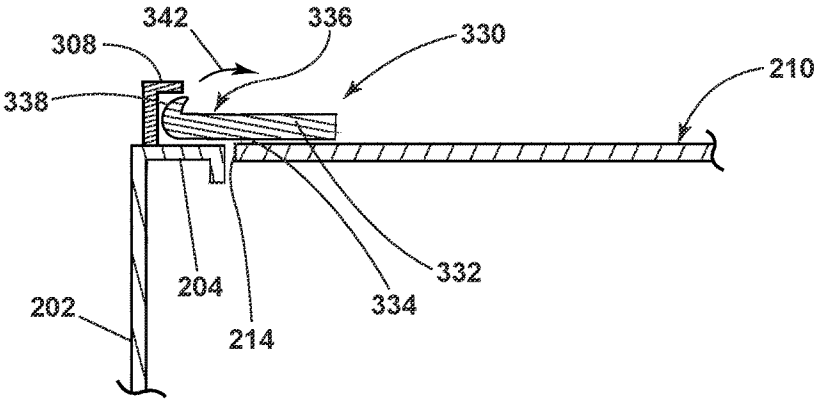
FIG. 7 is a schematic cross-sectional view of the closure assembly of FIG. 6.

Referring now to FIG. 7, the twist latch 330 comprises a grip portion 332 and an engagement portion 336. In one example, the grip portion 332 and the engagement portion 336 are provided opposite one another about the axis of rotation 334, which can be defined as a pin 334 coupling the twist latch 330 to the lid 210. The grip portion 332 and the engagement portion 336 can be in plane with one another such that both the grip portion 332 and the engagement portion 336 extend away from the axis of rotation 334 in opposite directions, yet still along the lid 210 in a manner that is substantially parallel to the lid 210. In a further example, when the twist latch 330 is in the closed position, as shown, to retain the lid 210 in the closed position, the grip portion 332 extends inwardly from the front edge 214 of the lid 210, while the engagement portion 336 extends outwardly away from the front edge 214 of the lid 210.

The engagement portion 336 includes a catch flange 338 extending upwardly from the engagement portion 336 and away from the lid 210. The tub cover 200 includes a lip 308 that extends upwardly from the top surface 204. It will be understood that the lip 308 can be provided as any suitable structure for engagement with the twist latch 330 to retain the twist latch 330, non-limiting examples of which include a flange, a clasp, an open channel, or other latching or retaining structure. When the lid 210 and the twist latch 330 are in the closed position, as shown, the catch flange 338 is at least partially received by and bears against the lip 308 such that the catch flange 338 is biased against the lip 308 to retain the lid 210 in the closed position by the upward force that is provided to the lid 210 by the spring-loaded hinge 220.

Turning now to the operation of the twist latch 330, when a user desires to open the lid 210 to access the treating chamber 118, the user can grasp or apply a twisting force to the grip portion 332 so as to rotate the grip portion 332 in the direction as shown by the arrow 342, causing the twist latch 330 to rotate about the axis of rotation 334, such as to rotate along the lid 210. As the twist latch 330 rotates about the axis of rotation 334, the engagement portion 336 is similarly rotated, in the direction as shown by the arrow 342. This rotational movement brings the catch flange 338 out of contact with the lip 308 such that the lid 210 is no longer retained in the closed position and can be lifted and rotated to the opened position, free from interference of the catch flange 338 contacting the lip 308.

When the lid 210 is returned to the closed position, the user can simply actuate the twist latch 330 by rotating the twist latch in the opposite direction of the arrow 342 to replace the catch flange 338 underneath the lip 308 and bearing upwardly against the lip 308 to prevent movement of the lid 210 to the opened position.

Figure 8:
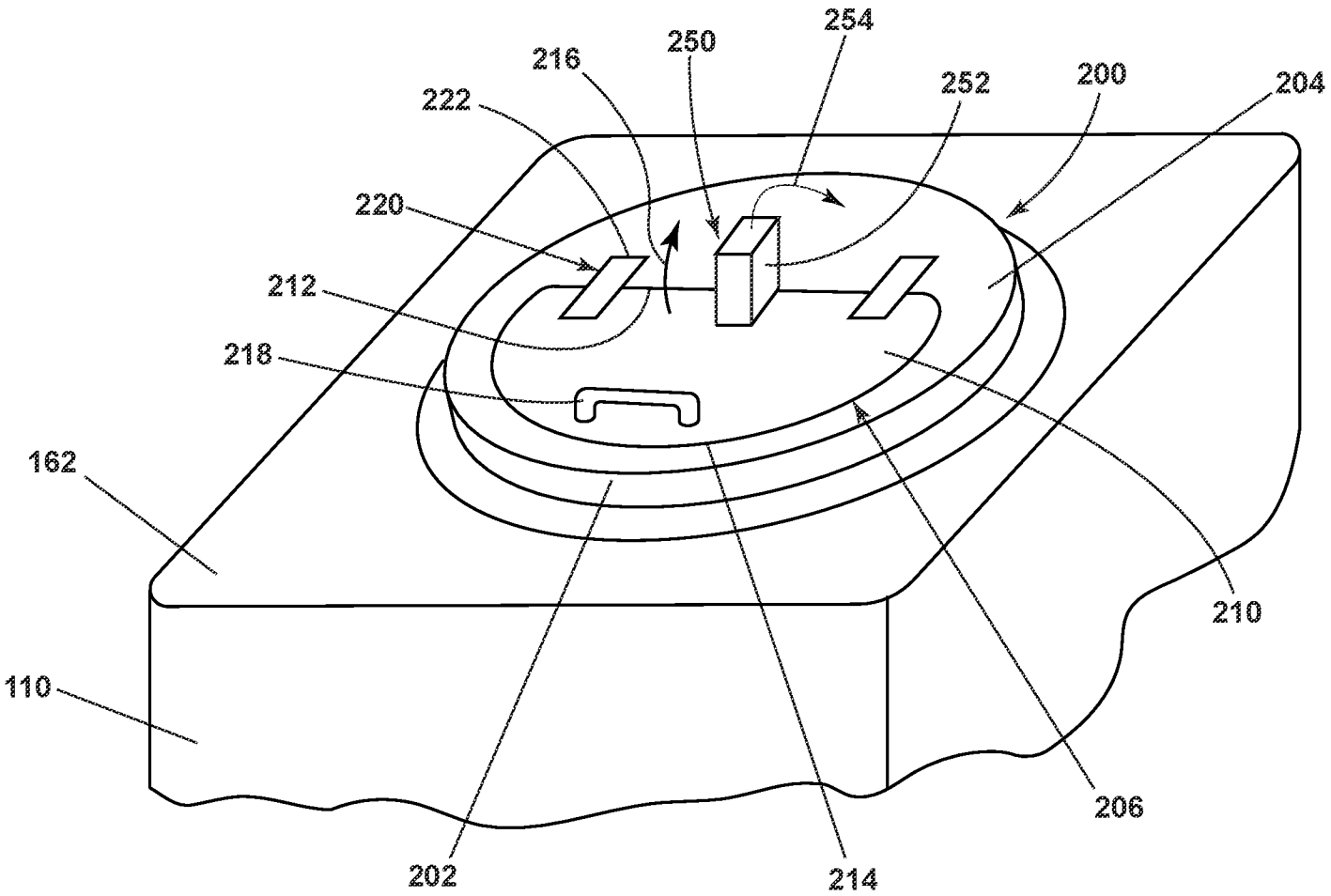
FIG. 8 is a schematic perspective view of another example of the tub cover for use with the laundry treating drawer of FIG. 1.

Referring now to FIG. 8, in another aspect of the present disclosure, the laundry treating drawer 100 can further comprise an automatic actuating assembly 250 configured to automatically close or open at least a portion of the tub cover 200 as the drawer body 110 is moved between the closed position and the opened position. The closure assemblies 230, 330 provide an advantage for the tub cover 200 in particular when the tub cover 200 includes the lid 210 that is biased toward the opened position, such as by the hinge 220 being provided as a spring-loaded hinge 220. In such a case, the closure assemblies 230, 330 retain the lid 210 in the closed position despite the biasing force applied to the lid 210 by the spring-loaded hinge 220. However, when the hinge 220 is not provided as a spring-loaded hinge 220 or the lid 210 is not biased toward the opened position, it may be desirable to a user for the laundry treating drawer 100 to include the automatic actuating assembly 250. With the inclusion of the automatic actuating assembly 250, rather than requiring a user to physically actuate the movement of the lid 210 both from the closed to the opened position, as well as from the opened to the closed position, the automatic actuating assembly 250 can automatically move at least a portion of the tub cover 200 at least one of from the opened position to the closed position or from the closed position to the opened position as the drawer body 110 is moved between the closed position and the opened position, reducing the amount of effort required by a user for operation of and interaction with the laundry treating drawer 100.

As illustrated herein, in this aspect, since the lid 210 does not include the closure assembly 230, 330, the lid 210 is instead provided with a handle 218. The handle 218 can be any suitable shape or configuration such that it can be gripped or grasped by the user to move the lid 210 between the opened and closed positions. Further, instead of the hinge 220 being provided as the spring-loaded hinge 220 and biasing the lid 210 toward the opened position as described previously, in one example, the hinge 220 can optionally still be provided as a spring-loaded hinge 220, but can instead in this case bias the lid 210 toward the closed position.

The lid 210 further includes the automatic actuating assembly 250, which is configured to actuate the lid 210 to automatically move from the closed position to the opened position in the direction of the arrow 216, and against the force applied to the lid 210 by the spring-loaded hinge 220 to bias the lid toward the closed position, as the drawer body 110 moves from the closed position to the opened position. Specifically, the automatic actuating assembly 250 comprises a rib 252 that can be automatically moved in the direction of the arrow 254 relative to the top surface 204 to move the lid 210 from the closed position to the opened position as the drawer body 110 moves from the closed position to the opened position. The rib 252 can be coupled to and can extend upwardly from the lid 210 and can be positioned adjacent the rear edge 212 of the lid 210.

Figure 9:
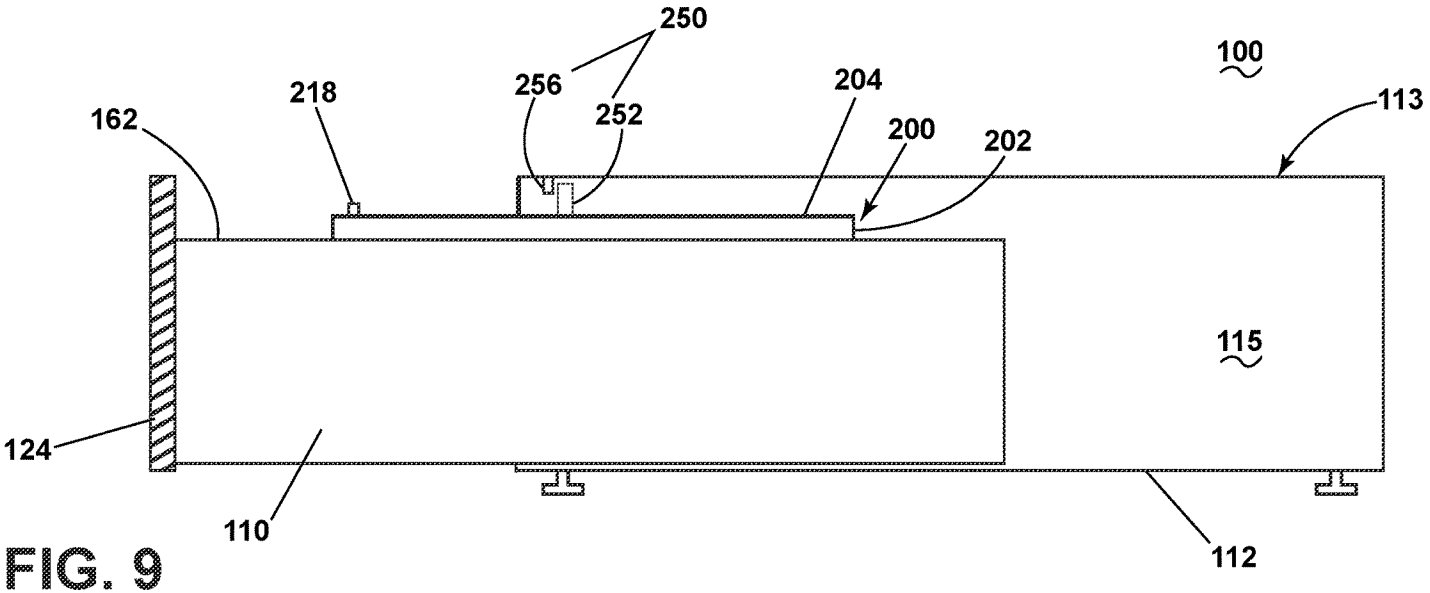
FIG. 9 is a schematic cross-sectional view of the laundry treating drawer of FIG. 8 with the drawer body in a partially opened position and the tub cover in a closed position.

Referring now to FIG. 9, the drawer body 110 is shown in a partially opened position relative to the drawer cabinet 112 and the lid 210 in a closed position relative to the tub cover 200 and to the access opening 104. The drawer cabinet 112 further includes a deflecting rib 256 that extends downwardly from an upper panel 113 of the drawer cabinet 112 and into an interior 115 of the drawer cabinet 112. The deflecting rib 256 can be selected to be sized and shaped such that the deflecting rib 256 contacts the rib 252 as the drawer body 110 moves from the closed to the opened position. The rib 252 and the deflecting rib 256 can be thought of as collectively forming the automatic actuating assembly 250. In the partially opened position as shown, the drawer body 110 has been opened and withdrawn from the drawer cabinet 112 to an extent that the rib 252 and the deflecting rib 256 are nearly abutting. The lid 210 remains in the closed position, which can be due to gravity or due to the biasing force of the spring-loaded hinge 220.

Figure 10:
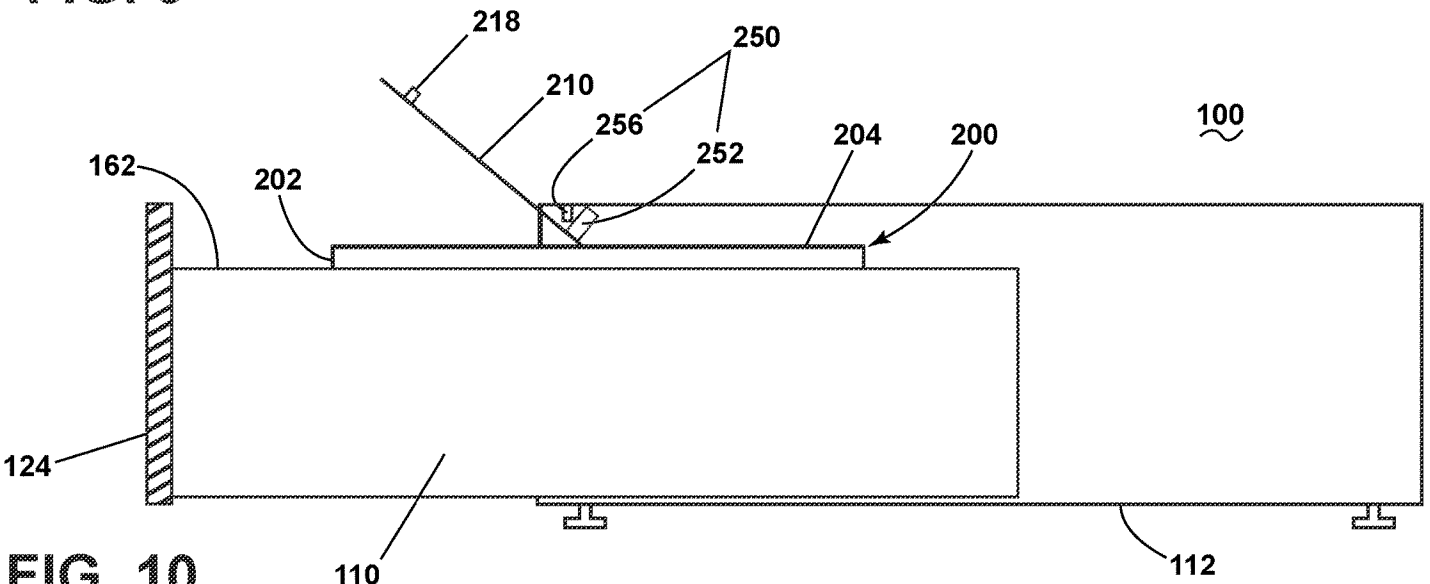
FIG. 10 is a schematic cross-sectional view of the laundry treating drawer of FIG. 8 with the drawer body in the opened position and the tub cover in an opened position.

Referring now to FIG. 10, the drawer body 110 is shown in a further opened position relative to the drawer cabinet 112, with the lid 210 in an at least partially opened position relative to the top surface 204 and to the access opening 104. In this position, the deflecting rib 256 contacts the rib 252 to prevent further forward movement of the rib 252 past the deflecting rib 256, even as the drawer body 110 is moved further forward out of the drawer cabinet 112. Instead, the deflecting rib 256 bears against the rib 252 to cause the rib 252 to be deflected rearwardly and downwardly toward the top surface 204 in the direction of the arrow 254, in turn causing the lid 210 to move from the closed position to the opened position.

Turning now to the operation of the automatic actuating assembly 250, as the user withdraws the drawer body 110 from the drawer cabinet 112 by pulling on the drawer front 124, the lid 210 is in the closed position and the rib 252 is moved toward the deflecting rib 256. Once the rib 252 has come into contact with the deflecting rib 256, as the drawer body 110 continues to be withdrawn forwardly from the drawer cabinet 112, the rib 252 is prevented from moving forward past the deflecting rib 256 and is instead deflected rearwardly and downwardly by the deflecting rib 256 to move towards the top surface 204. The movement of the rib 252 towards the top surface 204 correspondingly pulls the lid 210 upwardly and rearwardly from the closed position to move to the opened position, overcoming the force applied to the lid 210 by the spring-loaded hinge 220 to bias the lid 210 toward the closed position. When the drawer body 110 has reached the fully opened position, the lid 210 will also reach the opened position such that the user can access the treating chamber 118 through the access opening 104.

When the user has completed loading or unloading of the treating chamber 118 and no longer desires access, the user can move the drawer body 110 from the opened position to the closed position. As the drawer body 110 moves toward the closed position, the rib 252 is no longer deflected toward the top surface 204 by the deflecting rib 256 and the lid 210 can be allowed to be lowered into the closed position by gravity and/or by the biasing force applied to the lid 210 by the spring-loaded hinge 220 as the drawer body 110 moves toward the closed position. Alternatively, or additionally, the lid 210 can be deflected toward the closed position as the lid 210 comes into contact with the open face 106 of the drawer cabinet 112 as the drawer body 110 moves toward the closed position. In this way, the lid 210 is automatically opened and closed by the automatic actuating assembly 250 as the user moves the drawer body 110 between the closed position and the opened position. In addition, the automatic actuating assembly 250 functions to automatically open and close the lid 210 whether the lid 210 is biased toward the closed position by the spring-loaded hinge 220 or whether the hinge 220 does not exert any biasing force on the lid 210.

Figure 11:
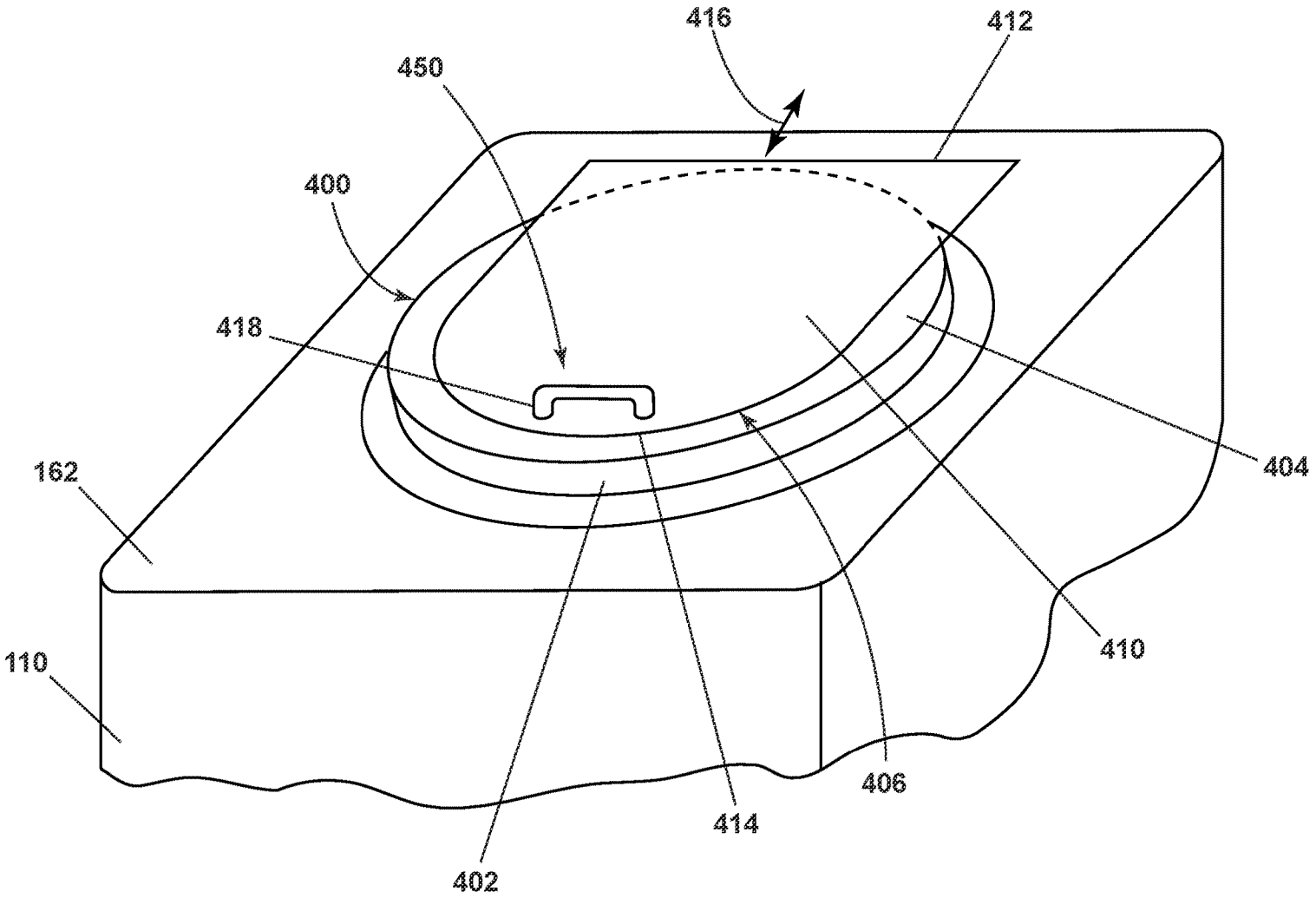
FIG. 11 is a schematic perspective view of another example of the tub cover for use with the laundry treating drawer of FIG. 1.

Turning now to FIG. 11, another example of a tub cover 400, a lid 410, and an automatic actuating assembly 450 that can be provided with the drawer body 110 is shown. The tub cover 400, the lid 410, and the automatic actuating assembly 450 are similar to the tub cover 200, the lid 210, and the automatic actuating assembly 250, respectively, but differ in some aspects, such as the shape of the lid 410 and the configuration of and relative movement between the tub cover 400, the lid 410, and the automatic actuating assembly 450. Therefore, elements of the tub cover 400, the lid 410, and the automatic actuating assembly 450 that are similar to those of the tub cover 200, the lid 210, and the automatic actuating assembly 250, respectively, are identified with numerals increased by 200, with it being understood that the description of the like parts of the tub cover 200, the lid 210, and the automatic actuating assembly 250 apply to the tub cover 400, the lid 410, and the automatic actuating assembly 450, respectively, unless otherwise noted.

The tub cover 400 can have a general shape that is similar to the tub cover 200 and includes a sidewall 402 and a top surface 404, but can differ from the tub cover 200 in the configuration of a lid opening 406 and the lid 410. Rather than the lid opening 206 extending across a smaller portion of the top surface 204 and entirely surrounding the lid 210, the lid opening 406 can extend across a larger portion of the width and depth of the top surface 404 and does not entirely surround a periphery of the lid 410. In one example, the lid opening 406 can surround or abut a front edge 414 of the lid 410, but does not surround or abut a rear edge 412 of the lid 410, such that the rear edge 412 extends beyond a periphery of the tub cover 400, and specifically extends beyond the sidewall 402. However, it will be understood that such an example is not limiting and that the lid 410 can have any suitable size and shape relative to the top surface 404, including that the lid 410 can extend entirely across the width and depth of the top surface 404, or even beyond the entire width and depth of the top surface 404.

The lid 410 is movably coupled to the top surface 404 for movement between a closed position, as shown, and an opened position (FIG. 13), and by way of non-limiting example, for slidable movement between the closed and opened positions in the direction of the arrow 416. As the lid 410 is configured for slidable movement relative to the tub cover 400 and to the access opening 104, no spring-loaded hinges 220 are included to bias the lid 410 to either the opened position or the closed position. Thus, in one example, the lid 410 is not biased toward either of the opened or closed positions and the closure assembly 230, 330 is not required to retain the lid 410 in either the opened or closed positions. However, it will be understood that the lid 410 could optionally include a biasing element (not shown) to bias the lid 410 either toward the opened position or toward the closed position. Further, it will be understood that, whether or not the lid 410 is biased toward either of the opened or closed positions, the closure assembly 230, 330 could still be optionally included to retain the lid in the closed position. Either of the closure assemblies 230, 330 could be used with the lid 410. Alternately, a different type of closure assembly, which could be any suitable type of latch or fastener, can be provided with the lid 410, and could be provided on either of the lid 410 or the tub cover 400, or both.

The automatic actuating assembly 450 is similar to the automatic actuating assembly 250, but differs in that the automatic actuating assembly 450 can include a handle 418 that extends upwardly from the lid 410 to act within the automatic actuating assembly 450, rather than including the separate rib 252 as in the automatic actuating assembly 250. The handle 418 can be positioned adjacent the front edge 414 of the lid 410. In addition, the automatic actuating assembly 450 can be configured to automatically close at least a portion of the tub cover 400, and specifically to close the lid 410, as the drawer body 110 is moved from the opened position to the closed position. The automatic actuating assembly 450 actuates the handle 418, and thus the lid 410, to automatically move relative to the top surface 404 to move the lid 410 from the opened position to the closed position in the orientation of the arrow 416 as the drawer body 110 moves toward the closed position.

Figure 12:
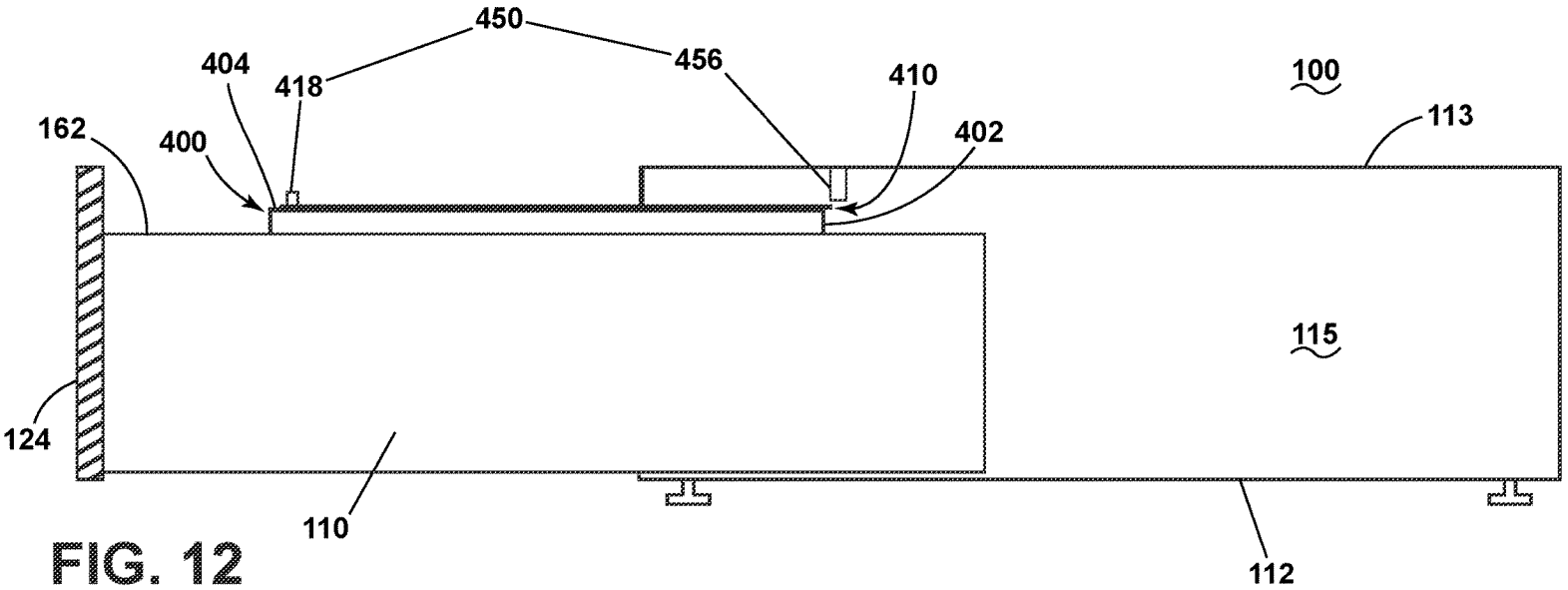
FIG. 12 is a schematic cross-sectional view of the laundry treating drawer of FIG. 11 with the drawer body in the opened position and the tub cover in a closed position.

Referring now to FIG. 12, the drawer body 110 is shown in an opened position relative to the drawer cabinet 112 and the lid 410 in a closed position relative to the tub cover 400 and to the access opening 104. The drawer cabinet 112 further includes a deflecting rib 456 that extends downwardly from an upper panel 113 of the drawer cabinet 112 and into an interior 115 of the drawer cabinet 112. The deflecting rib 456 can be selected to be sized and shaped such that the deflecting rib 456 contacts the handle 418 as the drawer body 110 moves from the closed to the opened position. The handle 418 and the deflecting rib 456 can be thought of as collectively forming the automatic actuating assembly 450. In the opened position as shown, the drawer body 110 is at least partially withdrawn from the drawer cabinet 112. The lid 410 remains in the closed position, which can be due to gravity or due to an optional biasing force.

Figure 13:
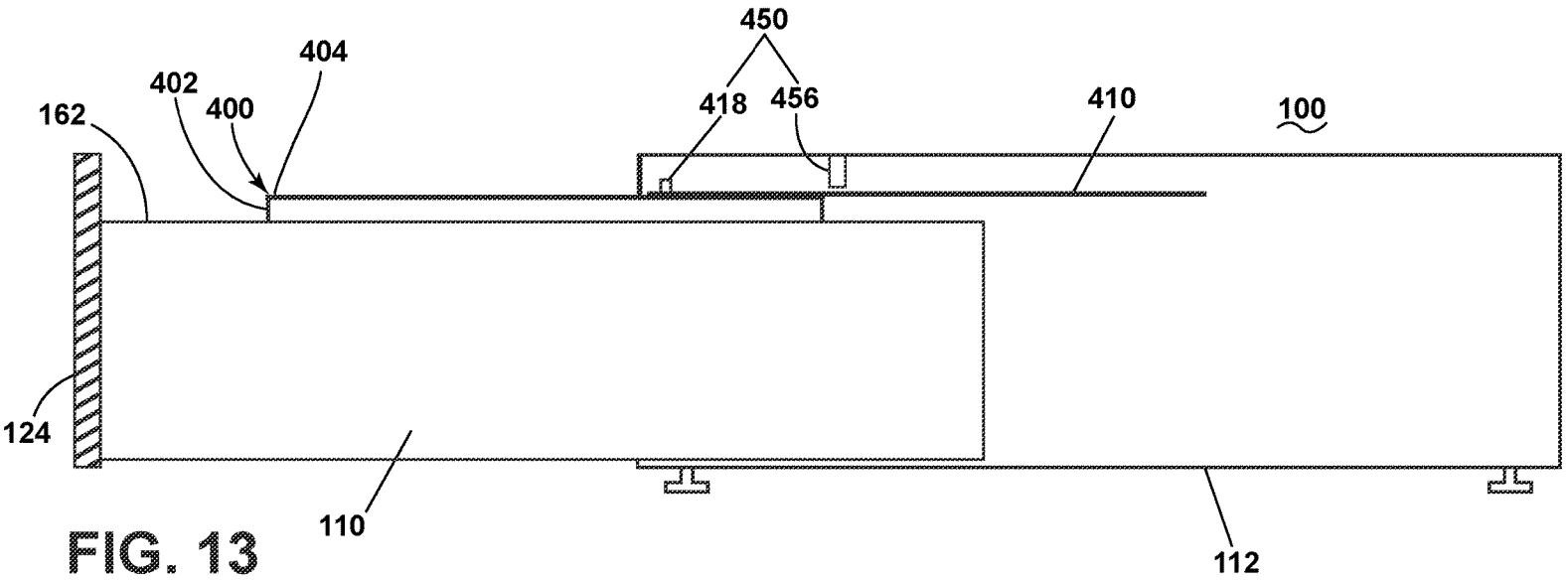
FIG. 13 is a schematic cross-sectional view of the laundry treating drawer of FIG. 11 with the drawer body in the opened position and the tub cover in an opened position.

Referring now to FIG. 13, the drawer body 110 remains in the opened position and the lid 410 is moved to the opened position relative to the top surface 404 and to the access opening 104. In this position, the lid 410 is moved rearwardly into the drawer cabinet 112 relative to the top surface 404. The lid 410 can be openable to any suitable extent to uncover any desired amount of the lid opening 406 or the access opening 104, up to the point at which the handle 418 comes into contact with the deflecting rib 456, at which point further rearward movement of the lid 410 into the drawer cabinet 112 is prevented.

Figure 14:
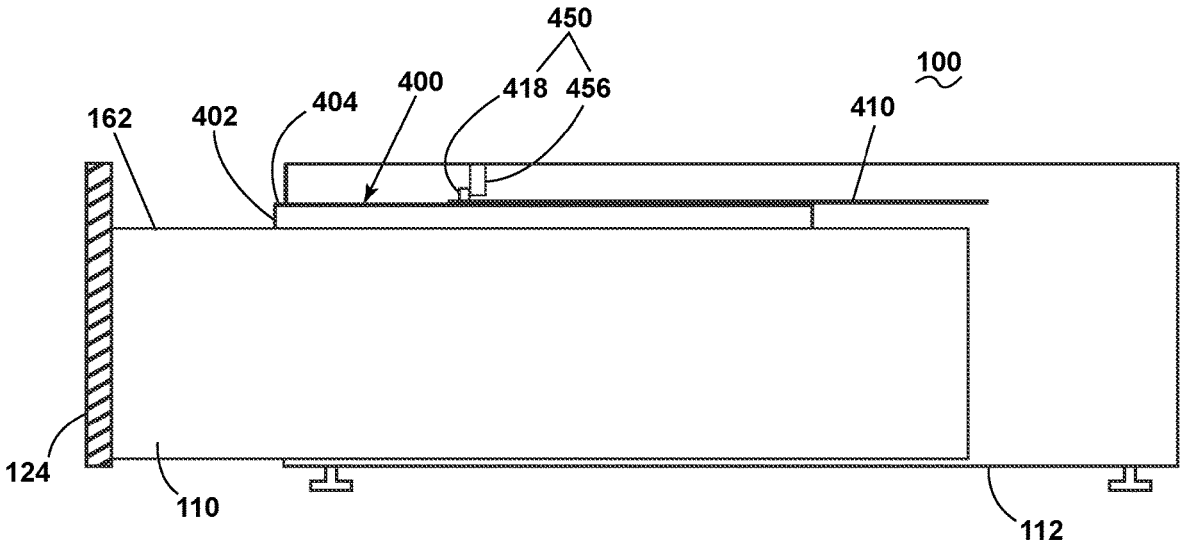
FIG. 14 is a schematic cross-sectional view of the laundry treating drawer of FIG. 11 with the drawer body in a partially closed position and the tub cover in a partially closed position.

Referring now to FIG. 14, the drawer body 110 is shown in a partially closed position relative to the drawer cabinet 112, with the lid 410 in a partially closed position relative to the top surface 404 and to the access opening 104. In this position, the deflecting rib 456 contacts the handle 418 and prevents further rearward movement of the handle 418 relative to or past the deflecting rib 456. Thus, even as the drawer body 110 is moved further rearward into the drawer cabinet 112, the handle 418, and thus also the lid 410, are held in place relative to the drawer body 110 and restricted from further rearward travel.

Figure 15:
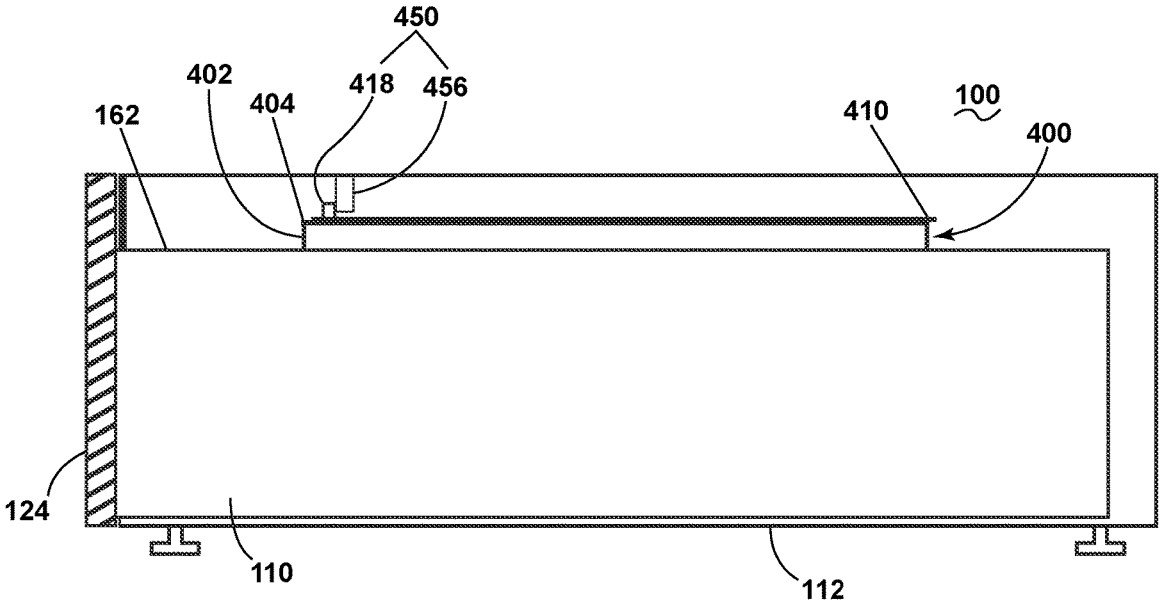
FIG. 15 is a schematic cross-sectional view of the laundry treating drawer of FIG. 11 with the drawer body in a closed position and the tub cover in the closed position.

Referring now to FIG. 15, the drawer body 110 is shown in a closed position relative to the drawer cabinet 112, with the lid 410 in a closed position relative to the top surface 404 and to the access opening 104. As in the position of FIG. 14, the deflecting rib 456 is in contact with the handle 418 and prevents rearward movement of the handle 418 relative to or rearwardly past the deflecting rib 456.

Turning now to the operation of the automatic actuating assembly 450, when the user withdraws the drawer body 110 from the drawer cabinet 112 by pulling on the drawer front 124 to move the drawer body 110 to the opened position, the lid 410 can remain in the closed position as it is presented to and becomes accessible to the user, as shown in FIG. 12. In order to access the treating chamber 118 through the access opening 104, the user can grasp the handle 418 and manually move the lid 410 to the opened position, as shown in FIG. 13, by pushing on the handle 418 to slide the lid 410 rearwardly into the drawer cabinet 112 up to the extent that the handle 418 comes into contact with the deflecting rib 456. Alternatively, the tub cover 400 or the lid 410 can include a means or element for biasing the lid 410 toward the opened position. In this case, as the user pulls on the drawer front 124 to move the drawer body 110 to the opened position, the lid 410 can be biased to the opened position to be presented to the user in the opened position once the drawer body 110 has reached the opened position.

When the user has completed loading or unloading of the treating chamber 118 and no longer desires access, the user can move the drawer body 110 from the opened position to the closed position by pushing on the drawer front 124 to move the drawer body 110 rearwardly into the drawer cabinet 112 until the drawer front 124 reaches the drawer cabinet 112 and closes the open face 106. As the user moves the drawer body 110 from the opened position to the closed position, the handle 418 is moved further toward the deflecting rib 456 until the handle 418 contacts and abuts the deflecting rib 456, as shown in FIG. 14.

Once the handle 418 abuts and bears against the deflecting rib 456, as the drawer body 110 continues to be inserted rearwardly into the drawer cabinet 112, the handle 418 is prevented from moving rearward past the deflecting rib 456 and is instead retained in place relative to the deflecting rib 456. When the handle 418 is retained in place relative to the deflecting rib 456 and the drawer body 110 is further inserted into the drawer cabinet 112, the handle 418 is effectively deflected forwardly relative to the tub cover 400 by the deflecting rib 456 for relative movement of the lid 410 toward the drawer front 124 to further close the lid opening 406 and the access opening 104. In the case that the tub cover 400 includes a means or an element for biasing the lid 410 toward the opened position, the force of the deflecting rib 456 bearing against the handle 418 is sufficient to overcome the force applied to bias the lid 410 toward the opened position, instead causing relative movement between the lid 410 and the tub cover 400 to move the lid toward the closed position. When the drawer body 110 has reached the fully closed position, as shown in FIG. 15, the lid 410 also reaches the fully closed position such that the lid opening 406 and the access opening 104 are completely closed.

When the user desires again to access the treating chamber 118 and moves the drawer body 110 toward the opened position, withdrawing the drawer body 110 from the drawer cabinet 112, the handle 418 no longer bears against or is deflected by the deflecting rib 456. At this point, the lid 410 can remain in the closed position due to gravity, or, in the case that the lid 410 is biased toward the opened position, once the handle 418 is no longer retained in the closed position by the deflecting rib 456, the lid 410 can then be biased toward the opened position as the drawer body 110 moves toward the opened position.

While the lid 410 is illustrated herein as being automatically actuated toward the closed position by the automatic actuating assembly 450 as the drawer body 110 is moved from the opened position toward the closed position, it will be understood that this is not limiting. For example, the deflecting rib 456, instead of being positioned rearward of the handle 418, can be positioned forward of the handle 418, between the handle 418 and the open face 106, such that the automatic actuating assembly 450 instead automatically actuates the lid 410 toward the opened position as the drawer body 110 is moved from the closed position to the opened position, similar to the action of the automatic actuating assembly 250. In this case, the tub cover 400 and the lid 410 could also include a separate means that biases the lid 410 toward the closed position, in opposition to the automatic actuating assembly 450.

In a further example, the automatic actuating assembly 450 can include both the deflecting rib 456 that is positioned rearward of the handle 418 to automatically actuate the lid 410 toward the closed position, as well as the deflecting rib 456 that is positioned forward of the handle 418 to automatically actuate the lid 410 toward the opened position. In this way, the handle 418 would always be retained between the two deflecting ribs 456, such that it remains within the drawer cabinet 112 and is not accessible by the user, but rather is automatically actuated both to the opened position and to the closed position as the drawer body 110 is moved between the opened and closed positions.

Figure 16:
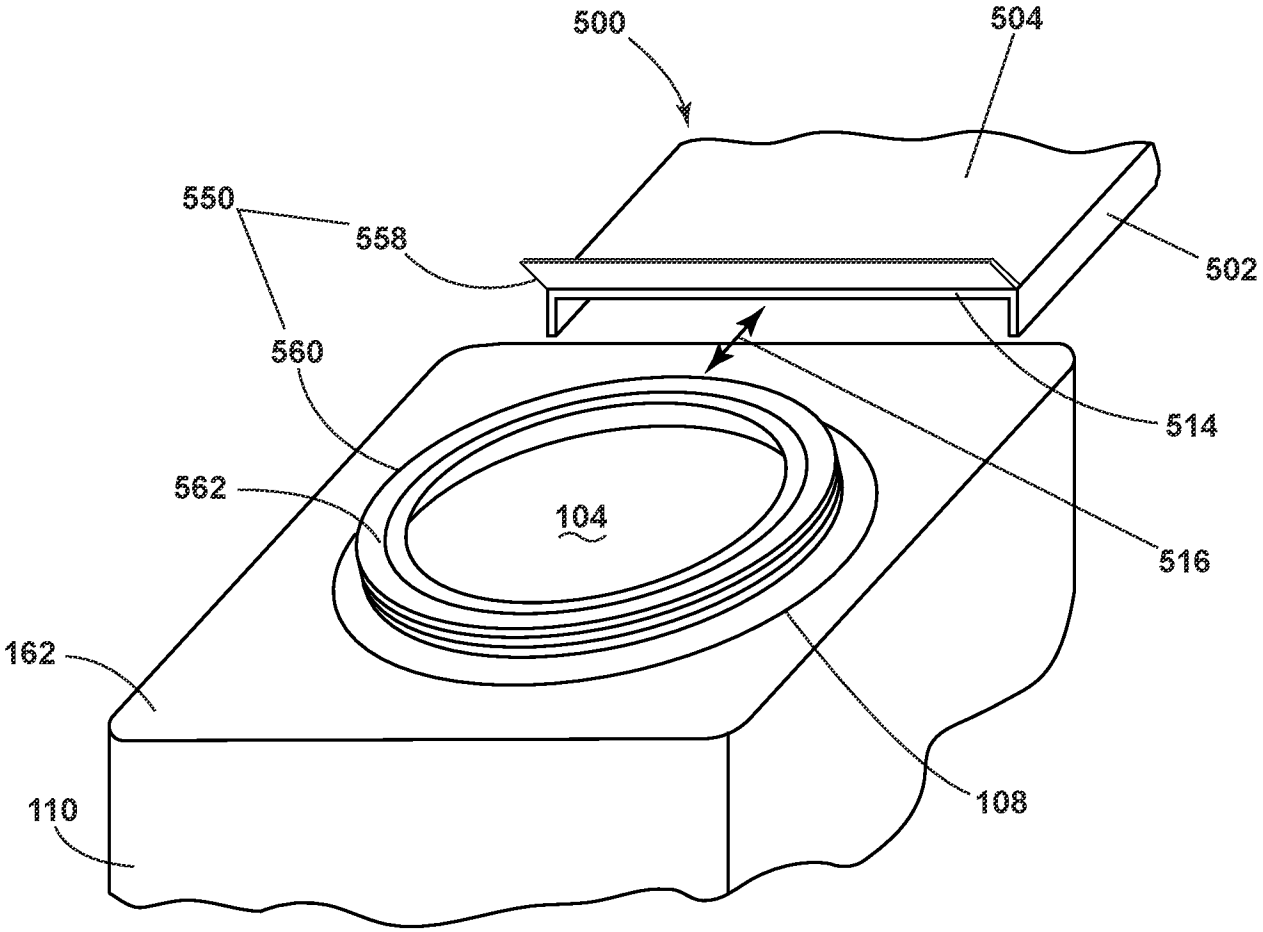
FIG. 16 is a schematic perspective view of another example of the tub cover for use with the laundry treating drawer of FIG. 1.

Referring now to FIG. 16, another example of a tub cover 500 with an automatic actuating assembly 550 that can be provided with the laundry treating drawer 100 is shown. The tub cover 500 and the automatic actuating assembly 550 are similar to the tub cover 400 and the automatic actuating assembly 450, respectively, but differ in some aspects, such as the location and configuration of the tub cover 500 and the relative movement between the tub cover 500 and the drawer body 110. Therefore, elements of the tub cover 500 and the automatic actuating assembly 550 that are similar to those of the tub cover 500 and the automatic actuating assembly 450, respectively, are identified with numerals increased by 100, with it being understood that the description of the like parts of the tub cover 400 and the automatic actuating assembly 450 apply to the tub cover 500 and the automatic actuating assembly 550, respectively, unless otherwise noted.

The tub cover 500 can differ from the tub cover 400 in the configuration of the tub cover 500 with respect to the drawer body 110, and in particular the tub opening 108 and the top panel 162. While the tub covers 200, 400 described previously were coupled to the top panel 162 and carried by the drawer body 110 to enclose the tub opening 108 and included lid openings 206, 406 through which the access opening 104 could be reached, the tub cover 500 is instead coupled to, either directly or indirectly, and carried by the drawer cabinet 112. In one example, the tub cover 500 is statically fixed to the drawer cabinet 112 for relative movement to the drawer body 110 to selectively sealingly close the access opening 104. In one example, the relative movement between the drawer body 110 and the tub cover 500 as the drawer body moves between the opened and closed positions is a sliding movement in accordance with the direction of the arrow 516.

The tub cover 500 comprises a pair of opposing sidewalls 502 spaced apart by a top surface 504. The top surface 504 can include a front edge 514 from which a deflecting ramp 558 extends. The deflecting ramp 558 can extend upwardly and forwardly from the front edge 514 such that the height of the deflecting ramp 558 relative to the top surface 504 decreases moving toward the front edge 514.

Figure 19:
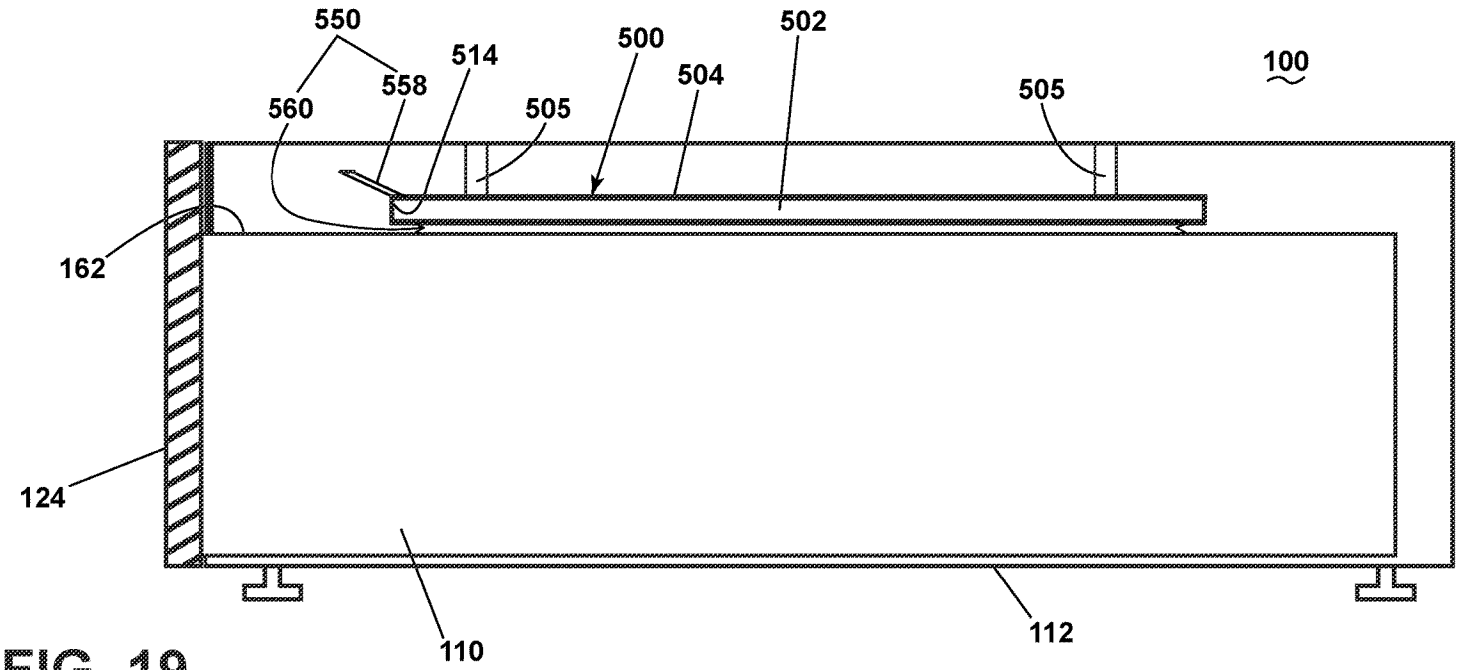
FIG. 19 is a schematic cross-sectional view of the laundry treating drawer of FIG. 16 with the drawer body in the closed position and the tub cover in the closed position.

As the entire tub cover 500 is moveable relative to the drawer body 110 to selectively close the access opening 104, the tub cover 500 does not include the lid opening 206, 406 or the lid 210, 410. Rather, the relative movement between the tub cover 500 and the drawer body 110, as well as the access opening 104, in the direction of the arrow 516, defines an opened position for the tub cover 500 relative to the access opening 104 as shown, as well as a closed position (FIG. 19). When the tub cover 500 is in the opened position relative to the access opening 104, the tub cover 500 is spaced from the access opening 104 and the treating chamber 118 such that a user can access the treating chamber 118 through the access opening 104. When the tub cover 500 is in the closed position relative to the access opening 104, the access opening 104 is closed, the tub cover 500 at least partially confronts the treating chamber 118, and access to the treating chamber 118 is prevented.

The drawer body 110 further comprises a flexible sealing element 560. The flexible sealing element 560 can include any suitable type of gasket or seal that is flexible or compliant to allow for movement resulting from the tub 114 during operation of the laundry treating drawer 100. By way of non-limiting example, the flexible sealing element 560 is illustrated herein as a bellows 560. The bellows 560 can surround and at least partially enclose the tub opening 108. The bellows 560 can be fixed to or coupled, either directly or indirectly, to the drawer body 110, and in particular to the top panel 162 and extends upwardly from the top panel 162. The bellows 560 includes an upper edge 562 that can seal against the tub cover 500 when the tub cover 500 is in the closed position relative to the access opening 104. In one example, the tub cover 500 can be sized and positioned so as to extend across the entire width and depth of the bellows 560 and to overlie the entire periphery of the bellows 560 when the tub cover 500 is in the closed position relative to the access opening 104.

The automatic actuating assembly 550 is configured to automatically provide the tub cover 500 to the opened and closed positions relative to the access opening 104 as the drawer body 110 is moved between the closed position and the opened position. The deflecting ramp 558 of the tub cover 500, together with the bellows 560, including the upper edge 562, can be thought of as collectively forming the automatic actuating assembly 550.

Figure 17:
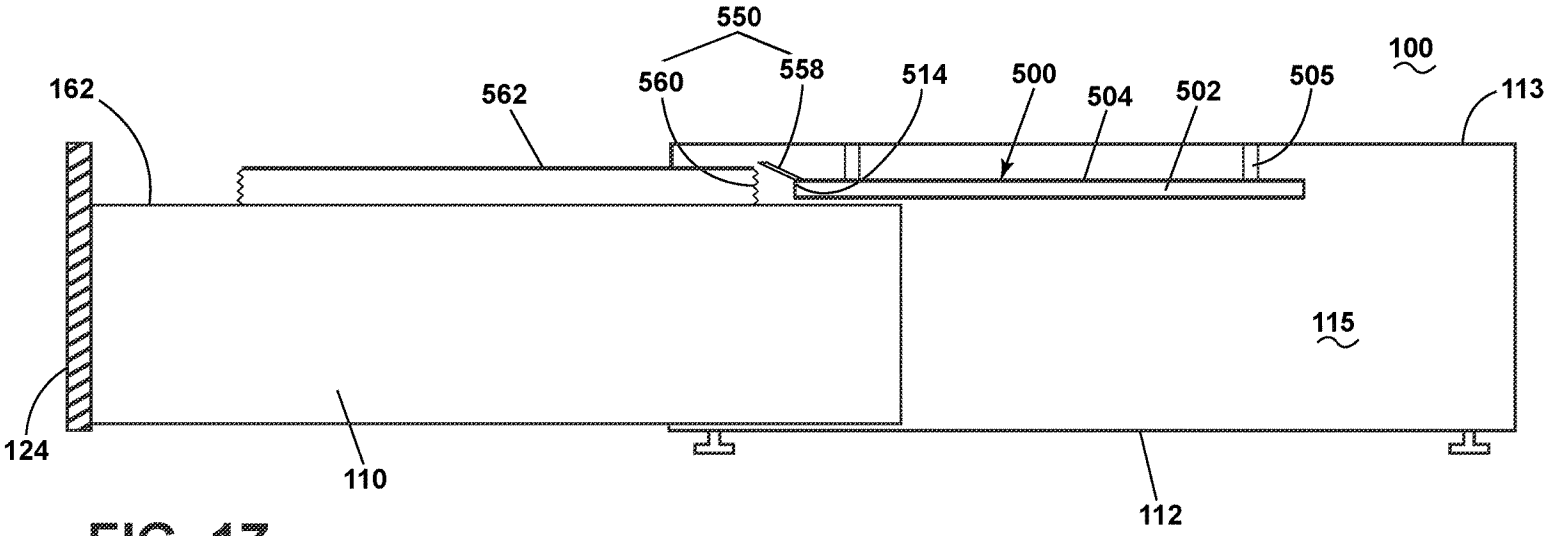
FIG. 17 is a schematic cross-sectional view of the laundry treating drawer of FIG. 16 with the drawer body in the opened position and the tub cover in an opened position.

Referring now to FIG. 17, the drawer body 110 is shown in an opened position relative to the drawer cabinet 112 and the tub cover 500 is shown in an opened position relative to the bellows 560 and to the access opening 104. The tub cover 500 is coupled to and carried by the upper panel 113 of the drawer cabinet 112 and extends downwardly from the upper panel 113 into the interior 115 of the drawer cabinet 112. The tub cover 500 can be coupled to the upper panel 113 by at least one fastening element 505 that extends between the upper panel 113 and the top surface 504 and mounts the tub cover 500 such that the top surface 504 is spaced from the upper panel 113 to allow for the vertical height of the deflecting ramp 558. The at least one fastening element 505 can be any suitable type of fastening or mounting element that can maintain the tub cover 500 fixed in a spaced relation to the upper panel 113. By way of non-limiting example, the at least one fastening element 505 can be a bracket.

The vertical height and the angle of the deflecting ramp 558 can be selected such that a peripheral edge of the deflecting ramp 558 is positioned vertically higher than the upper edge 562 of the bellows 560, while the top surface 504 of the tub cover 500 is positioned vertically lower than the upper edge 562 of the bellows 560. In the position as shown, the bellows 560 does not contact or abut the deflecting ramp 558 of the tub cover 500. Further, the bellows 560 is provided in an uncompressed position such that the upper edge 562 of the bellows 560 defines a full vertical height of the bellows 560 and is not bearing against or deflected by any other element.

Figure 18:
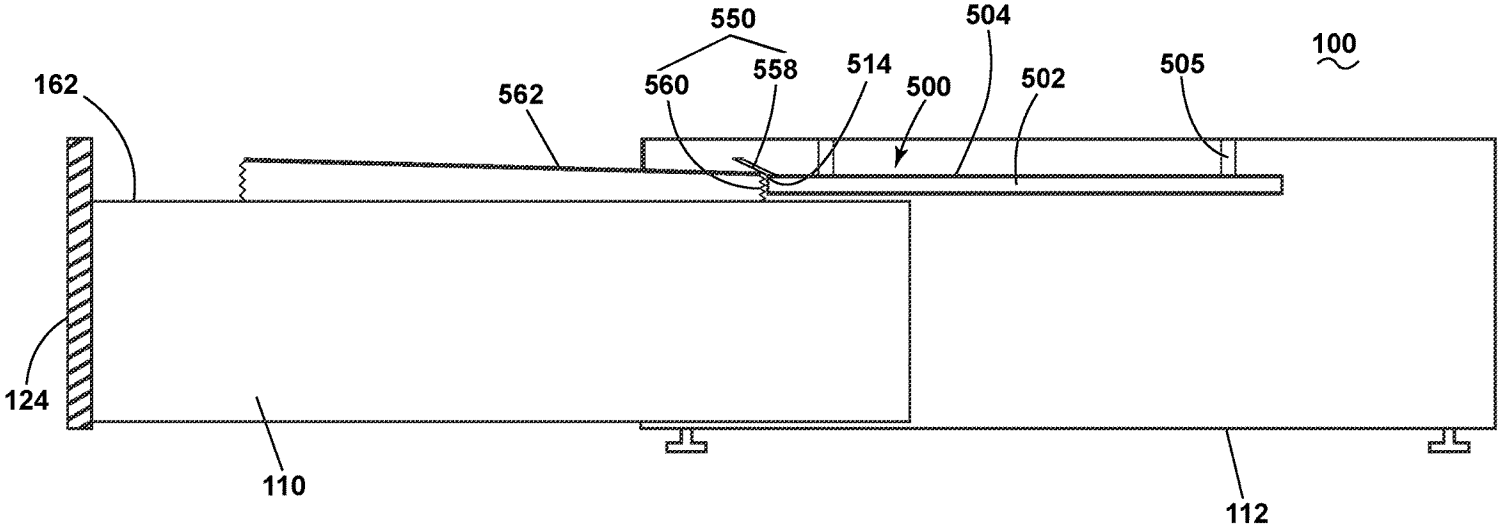
FIG. 18 is a schematic cross-sectional view of the laundry treating drawer of FIG. 16 with the drawer body in the partially closed position and the tub cover in a partially closed position.

Referring now to FIG. 18, the drawer body 110 is shown in a partially closed or partially opened position relative to the drawer cabinet 112 and the tub cover 500 is shown in a partially closed or partially opened position relative to the bellows 560 and to the access opening 104. In this position, a portion of the bellows 560, including a portion of the upper edge 562, contacts or abuts the deflecting ramp 558, such that the portions of the bellows and the upper edge 562 that abut the deflecting ramp 558 are downwardly deflected and vertically compressed by the deflecting ramp 558 moving towards the top surface 504 to bear upwardly against the deflecting ramp 558. The vertically compressed portions have a vertical height defined by the upper edge 562 that is less than the vertical height defined by the upper edge 562 at uncompressed portions of the bellows 560. The deflecting ramp 558 prevents further rearward movement of the bellows 560 relative to the deflecting ramp 558 without vertical compression of the bellows 560.

Referring now to FIG. 19, the drawer body 110 is shown in a closed position relative to the drawer cabinet 112, with the tub cover 500 in a closed position relative to the bellows 560 and to the access opening 104. In this position, the bellows 560 is entirely received below and underlies the top surface 504 of the tub cover 500. Thus, the entire bellows 560 is downwardly deflected and is held in the vertically compressed position by the top surface 504. The bellows 560 in the vertically compressed condition has a vertical height defined by the upper edge 562 that is less than the vertical height defined by the upper edge 562 when the bellows 560 is in the uncompressed condition.

Figure 20:
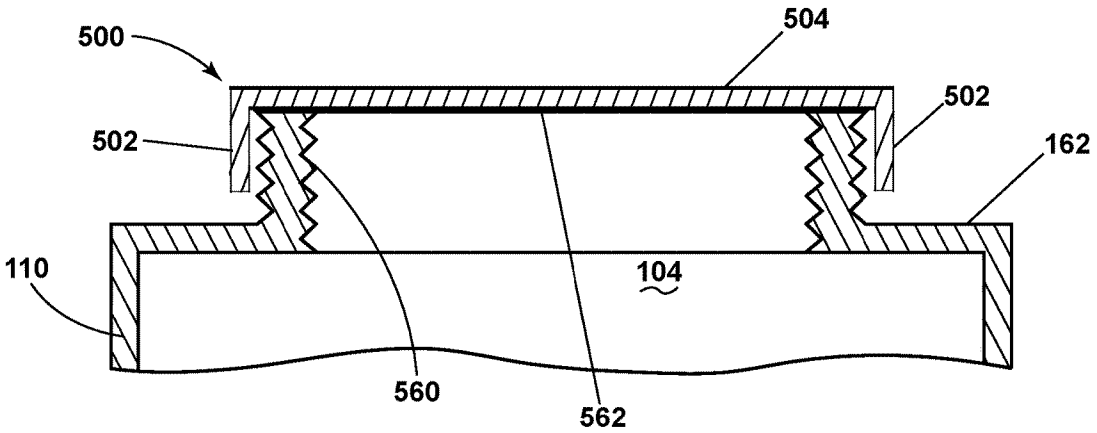
FIG. 20 is a schematic cross-sectional view of the tub cover of FIG. 19 with the tub cover in the closed position and taken from the front of the tub cover.

Referring now to FIG. 20, with the tub cover 500 in the closed position relative to the bellows 560 and to the access opening 104, the top surface 504 overlies the bellows 560 to downwardly deflect and vertically compress the bellows. When the top surface 504 compresses the bellows 560, the upper edge 562 of the bellows 560 bears upwardly against the top surface 504. In one example, the upward force of the compressed bellows 560 bearing against the top surface 504 is sufficient for the upper edge 562 of the bellows 560 to seal against the tub cover 500, and specifically against the top surface 504.

Turning now to the operation of the automatic actuating assembly 550, when the user withdraws the drawer body 110 from the drawer cabinet 112 by pulling on the drawer front 124 to move the drawer body 110 to the opened position, the drawer body 110 is withdrawn from underlying the tub cover 500. As the drawer body 110 is withdrawn from underlying the tub cover 500, the treating chamber 118, the access opening 104, and the bellows 560 are likewise at least partially withdrawn from underlying the tub cover 500, resulting in the tub cover 500 being in the opened position relative to the bellows 560 and to the access opening 104 when the drawer body 110 reaches the opened position. As the bellows 560 is withdrawn from underlying the tub cover 500, the tub cover 500 no longer vertically compresses the bellows 560, allowing the bellows 560 to return to the uncompressed condition with the upper edge 562 of the bellows 560 defining a maximum vertical height of the bellows 560. In this way, the automatic actuating assembly 550 allows the tub cover 500 to be automatically provided to the opened position relative to the bellows 560 and to the access opening 104, as shown in FIG. 17, as the drawer body 110 is withdrawn from the drawer cabinet 112 to the opened position, such that the user can access the treating chamber 118 through the access opening 104 when the drawer body 110 is in the opened position.

When the user has completed loading or unloading of the treating chamber 118 and no longer desires access, the user can move the drawer body 110 from the opened position to the closed position by pushing on the drawer front 124 to move the drawer body 110 rearwardly into the drawer cabinet 112 until the drawer front 124 reaches the drawer cabinet 112 and closes the open face 106. As the user moves the drawer body 110 from the opened position to the closed position, the bellows 560 is moved rearwardly toward the deflecting ramp 558 until the bellows 560 is brought into contact with and abuts the deflecting ramp 558, as shown in FIG. 18.

Once the bellows 560, including the upper edge 562, abuts and bears against the deflecting ramp 558, as the drawer body 110 continues to be inserted rearwardly into the drawer cabinet 112, the bellows 560 moves rearwardly along the deflecting ramp 558 toward the front edge 514 and the top surface 504 of the tub cover 500. As the bellows 560 is moved along the deflecting ramp 558 toward the front edge 514, the deflecting ramp 558 is angled downwardly relative to the travel path of the bellows 560, such that the deflecting ramp 558 decreases in height towards the front edge 514. As the bellows is moved along and confronts the decreasing height of the deflecting ramp 558, the deflecting ramp 558 gradually downwardly deflects and vertically compresses the bellows 560. When the bellows 560 and the upper edge 562 reach the front edge 514 of the top surface 504, the vertical height of the bellows 560 and the upper edge 562 is sufficiently vertically compressed to the vertical position of the top surface 504 such that the bellows 560 and the upper edge 562 can fit beneath the top surface 504 to underlie the top surface 504.

As the drawer body 110 continues to be further inserted into the drawer cabinet 112, a larger portion of the depth or width of the bellows 560 continues to be vertically compressed by the deflecting ramp 558 to be provided to underlie the top surface 504 of the tub cover 500. When the drawer body 110 has reached the fully closed position, as shown in FIG. 19, the tub cover 500 likewise reaches the fully closed position relative to the bellows 560 and the access opening 104 such that the bellows 560 completely underlies the tub cover 500 to seal against the tub cover 500 and the access opening 104 is completely closed. In this way, the deflecting ramp 558 and the bellows 560 together act as the automatic actuating assembly 550 to gradually downwardly deflect and vertically compress the bellows 560 until it can be provided to underlie the top surface 504 of the tub cover 500, automatically moving to the closed position of the tub cover 500 relative to the access opening 104 as the drawer body 110 is moved from the opened position to the closed position.

If the deflecting ramp 558 was not included to act within the automatic actuating assembly 550, the bellows 560 would have an uncompressed vertical height greater than the vertical height of the top surface 504 when the bellows 560 was brought into contact with the front edge 514 of the tub cover 500. In this case, rather than the bellows 560 becoming vertically compressed to fit beneath the top surface 504, the bellows 560 could be caught against the tub cover 500 and prevent further rearward insertion of the drawer body 110 into the drawer cabinet 112. The inclusion of the deflecting ramp 558 and the automatic actuating assembly 550 ensure that the bellows 560 and the access opening 104 can be easily and automatically provided to the closed position relative to the tub cover 500, and further allow for effective sealing engagement of the bellows 560 with the tub cover 500 in the closed position.

The aspects of the present disclosure described herein set forth a laundry treating drawer including a tub cover with a variety of advantageous aspects. The inclusion of the tub cover can improve liquid retention within the treating chamber and can prevent liquid from splashing outside of the treating chamber or humidity from escaping the treating chamber during a cycle of operation. The tub cover can further include features to improve user experience with the laundry treating drawer, such as tub covers or lids that can be biased to an opened or closed position to reduce user effort in gaining access to or in closing the access opening, closure assemblies for retaining the tub cover or lids in the closed position, and a variety of configurations for the opening or closing of the tub cover or lid to meet a wide range of user preferences, including automatic actuating assemblies by which the tub cover or lid can be automatically opened or closed as the laundry treating drawer is opened or closed, providing an improved user experience by not requiring the user to manually open and close the closure for the treating chamber, as well as ensuring improve performance of the laundry treating drawer by ensuring that the treating chamber opening is properly and sealingly closed with each use to minimize liquid escaping the treating chamber.

It will also be understood that various changes and/or modifications can be made without departing from the spirit of the present disclosure. By way of non-limiting example, although the present disclosure is described for use with a pedestal laundry treating drawer, it will be recognized that the aspects of the laundry treating drawer can be employed with various constructions, including that aspects of the present disclosure can be applicable for any type of laundry treating appliance with a vertical axis treating chamber that can be withdrawn from a cabinet between an opened and closed position. In addition, while aspects of the present disclosure related to tub covers, closures, and lid options are described for use with a laundry treating drawer, it will be recognized that the aspects of the tub covers, closures, and lids can be applicable for any type of laundry treating appliance with a top-loading treating chamber To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A laundry treating system comprising a first laundry treating appliance and a drawer-style laundry treating appliance positioned below the first laundry treating appliance, the drawer-style laundry treating appliance comprising:

a cabinet defining an interior and having an open face;

a drawer body slidably received within the cabinet for movement through the open face between a closed position wherein the drawer body is received within the interior and an opened position wherein the drawer body is at least partially withdrawn from the interior;

a tub located within the interior, carried by the drawer body, and having a tub opening accessible when the drawer body is in the opened position, the tub further at least partially defining a treating chamber accessible through the tub opening; and a tub cover selectively sealingly closing the tub opening and defining a lid opening, the tub cover comprising:

a lid carried by and movably mounted to the tub cover for movement between opened and closed positions to selectively open or close the lid opening; and at least one automatic actuating assembly selectively automatically moving the lid toward at least one of the opened position or the closed position as the drawer body is moved between the closed position and the opened position.

2. The laundry treating system of claim 1 wherein the tub is at least partially withdrawn from the interior through the open face when the drawer body is in the opened position.

3. The laundry treating system of claim 2 wherein the lid is movable to the opened position when the drawer body is in the opened position.

4. The laundry treating system of claim 1 wherein the tub cover surrounds and at least partially encloses the tub opening.

5. The laundry treating system of claim 1 wherein the lid seals against the tub cover when the lid is in the closed position.

6. The laundry treating system of claim 1 wherein the at least one automatic actuating assembly biases the lid toward the opened position.

7. The laundry treating system of claim 6 wherein the tub cover further comprises a closure to retain the lid in the closed position.

8. The laundry treating system of claim 1 wherein the at least one automatic actuating assembly biases the lid toward the closed position.

9. The laundry treating system of claim 1 wherein the cabinet is provided as a pedestal positioned below and configured to support the first laundry treating appliance.

10. The laundry treating system of claim 1 further comprising a rotatable drum positioned within the tub and further at least partially defining the treating chamber.

11. The laundry treating system of claim 1 wherein a suspension assembly supports and carries the tub within the drawer body.

12. The laundry treating system of claim 1 wherein the tub at least partially defines a sump, and further comprising a sump heater provided within the sump.

13. The laundry treating system of claim 1 wherein the lid only partially covers the tub opening.

14. The laundry treating system of claim 1 wherein the at least one automatic actuating assembly comprises at least one hinge coupling the lid to the tub cover for movement between the opened and closed positions, the at least one hinge biasing the lid toward one of the opened position or the closed position.

15. A drawer-style laundry treating appliance comprising:

a cabinet defining an interior and having an open face;

a drawer body slidably received within the cabinet for movement through the open face between a closed position wherein the drawer body is received within the interior and an opened position wherein the drawer body is at least partially withdrawn from the interior;

a tub located within the interior, carried by the drawer body, and having a tub opening accessible when the drawer body is in the opened position, the tub further at least partially defining a treating chamber accessible through the tub opening; and a tub cover selectively sealingly closing the tub opening and defining a lid opening, the tub cover comprising:

a lid carried by and movably mounted to the tub cover for movement between opened and closed positions to selectively open or close the lid opening;

at least one automatic actuating assembly selectively automatically moving the lid toward at least one of the opened position or the closed position as the drawer body is moved between the closed position and the opened position; and at least one hinge coupling the lid to the tub cover for movement between the opened and closed positions, the at least one hinge biasing the lid toward one of the opened position or the closed position.

16. The drawer-style laundry treating appliance of claim 15 wherein the lid is movable to the opened position when the drawer body is at least partially withdrawn from the interior through the open face.

17. The drawer-style laundry treating appliance of claim 15 wherein the lid seals against the tub cover when the lid is in the closed position.

18. The drawer-style laundry treating appliance of claim 15 wherein the at least one hinge biases the lid toward the opened position.

19. The drawer-style laundry treating appliance of claim 18 wherein the tub cover further comprises a closure to retain the lid in the closed position.

20. The drawer-style laundry treating appliance of claim 15 wherein the at least one hinge biases the lid toward the closed position.

* * * * *